US008991607B2

(12) United States Patent
Wagner et al.

(10) Patent No.: US 8,991,607 B2
(45) **Date of Patent: *Mar. 31, 2015**

(54) SYSTEM FOR OPENING A MEDICAL BLISTER PACKAGE

(75) Inventors: John Wagner, Værløse (DK); Flemming Wagner, Frederiksberg C (DK)

(73) Assignee: MedComb Holding ApS, Copenhagen V (DK)

( * ) Notice: Subject to any disclaimer, the term of this patent is extended or adjusted under 35 U.S.C. 154(b) by 23 days.

This patent is subject to a terminal disclaimer.

(21) Appl. No.: 13/634,814

(22) PCT Filed: Mar. 18, 2011

(86) PCT No.: PCT/DK2011/050088

§ 371 (c)(1), (2), (4) Date: Nov. 5, 2012

(87) PCT Pub. No.: WO2011/113440

PCT Pub. Date: Sep. 22, 2011

(65) Prior Publication Data

US 2013/0037436 A1 Feb. 14, 2013

Related U.S. Application Data

(60) Provisional application No. 61/315,258, filed on Mar. 18, 2010, provisional application No. 61/315,273, filed on Mar. 18, 2010.

(30) Foreign Application Priority Data

Mar. 18, 2010 (DK) ..... 2010 70107
Mar. 18, 2010 (DK) ..... 2010 70108

(51) Int. Cl.
*B65D 83/04* (2006.01)
*B65D 75/32* (2006.01)
*A61J 1/03* (2006.01)
(Continued)

(52) U.S. Cl.
CPC ..... *B65D 75/327* (2013.01); *A61J 1/03* (2013.01); *A61J 1/035* (2013.01); *B65D 81/05* (2013.01); *B65D 81/3816* (2013.01);
(Continued)

(58) Field of Classification Search
USPC ..... 206/528, 531, 532, 538, 539, 484.2, 206/484, 828, 223
See application file for complete search history.

(56) References Cited

U.S. PATENT DOCUMENTS 3,809,220 A 5/1974 Arcudi
3,809,221 A * 5/1974 Compere ..... 206/531
(Continued)

FOREIGN PATENT DOCUMENTS

CN 1860072 A 11/2006
CN 1953916 A 4/2007
(Continued)

*Primary Examiner* — Steven A Reynolds
*Assistant Examiner* — Javier A Pagan
(74) *Attorney, Agent, or Firm* — Knobbe Martens Olson & Bear LLP

(57) ABSTRACT

The invention relates to a system for opening a medical blister package which is easy and convenient to open for people of all level of ability and dexterity. Its design allows for selective access to the blisters by following a predetermined opening sequence, therefore minimizing involuntary wrong up taking of medicine due to patient errors as wrong sequential opening is not achievable by involuntary mistakes.

18 Claims, 33 Drawing Sheets

(51) Int. Cl.
*B65D 81/05* (2006.01)
*B65D 81/38* (2006.01)

(52) U.S. Cl.
CPC ... *B65D 83/0463* (2013.01); *B65D 2575/3245* (2013.01); *B65D 2585/56* (2013.01)
USPC ..... 206/532; 206/538; 206/484.2

(56) References Cited

U.S. PATENT DOCUMENTS

| | | | | |
|---|---|---|---|---|
| 3,835,995 | A | 9/1974 | Haines | |
| 3,924,748 | A | 12/1975 | Braverman | |
| 4,254,871 | A | 3/1981 | Poore | |
| 4,627,432 | A | 12/1986 | Newell et al. | |
| 4,850,489 | A | 7/1989 | Weithmann et al. | |
| 4,889,238 | A | 12/1989 | Batchelor | |
| 5,240,113 | A | 8/1993 | Gibilisco | |
| 5,325,968 | A * | 7/1994 | Sowden | 206/532 |
| 5,358,118 | A | 10/1994 | Thompson et al. | |
| 5,381,904 | A | 1/1995 | Thurell | |
| 5,788,079 | A | 8/1998 | Bouthiette | |
| 5,909,822 | A | 6/1999 | George et al. | |
| 6,375,956 | B1 | 4/2002 | Hermelin et al. | |
| 8,459,458 | B2 * | 6/2013 | Wagner et al. | 206/532 |
| 2001/0030140 | A1 | 10/2001 | Mundt | |
| 2002/0162769 | A1 | 11/2002 | Weinstein | |
| 2003/0098257 | A1 | 5/2003 | Robertson | |
| 2003/0102247 | A1 | 6/2003 | Inoue et al. | |
| 2004/0266745 | A1 | 12/2004 | Schwanitz et al. | |
| 2005/0077203 | A1 | 4/2005 | Morita et al. | |
| 2005/0084700 | A1 | 4/2005 | Ede et al. | |
| 2006/0289328 | A1 * | 12/2006 | Hession | 206/531 |
| 2007/0015728 | A1 | 1/2007 | Ford | |
| 2007/0015839 | A1 | 1/2007 | Folli et al. | |
| 2007/0187273 | A1 | 8/2007 | Grosskopf | |

FOREIGN PATENT DOCUMENTS

| | | | |
|---|---|---|---|
| EP | 1462384 | A1 | 9/2004 |
| EP | 1 502 568 | A1 | 2/2005 |
| WO | WO 98/22072 | | 5/1998 |
| WO | WO 03/079959 | A1 | 10/2003 |
| WO | WO 2004/031050 | A1 | 4/2004 |
| WO | WO 2004/089274 | A1 | 10/2004 |
| WO | WO 2005/023670 | A1 | 3/2005 |
| WO | WO 2005/068304 | A2 | 7/2005 |
| WO | WO 2005/120984 | A1 | 12/2005 |
| WO | WO 2006/057600 | A1 | 6/2006 |
| WO | WO 2007/072494 | A1 | 6/2007 |
| WO | WO 2008/014862 | A1 | 2/2008 |
| WO | WO 2008/104765 | A1 | 9/2008 |

* cited by examiner

SYSTEM FOR OPENING A MEDICAL BLISTER PACKAGE

CROSS REFERENCE TO RELATED APPLICATIONS

This application is a U.S. National Phase Application of PCT International Application Number PCT/DK2011/050088, filed on Mar. 18, 2011, designating the United States of America and published in the English language, which is an International Application of and claims the benefit of priority to Danish Patent Application No. PA 2010 70108, filed on Mar. 18, 2010, U.S. Provisional Application No. 61/315,258, filed on Mar. 18, 2010, Danish Patent Application No. PA 2010 70107, filed on Mar. 18, 2010, and U.S. Provisional Application No. 61/315,273, filed on Mar. 18, 2010. The disclosures of the above-referenced applications are hereby expressly incorporated by reference in their entireties.

FIELD OF THE INVENTION

The present invention relates to a system for opening a medical blister package.

BACKGROUND OF THE INVENTION

Physiological requirements vary from individual to individual and even within an individual during the course of a lifetime. Further, various conditions may effect physiological requirements. For example, pregnant, lactating and menopausal women may have enhanced needs for certain nutrients, therapeutic agents or treatments and reduced needs, or even tolerance, for other nutrients, therapeutic agents or treatments. Meeting the specific physiological requirements of humans and other animals may require the use of a complex daily therapeutic regimen requiring administration of various biologically-active substances at different times during the day.

A WHO study estimates that only 50% of patients suffering from chronic diseases in developed countries follow treatment recommendations. This may affect patient health, and affect the wider society when it causes complications from chronic diseases, formation of resistant infections, or untreated psychiatric illness.

There are a broad range of factors which play a role in poor patient compliance, including complexity of regimen, instructions for administration not clear, purpose of treatment not clear, forgetfulness and physical difficulty in complying, e.g. opening medicine containers.

This compliance problem is further compounded where the treatment regime is complex, requiring multiple doses per day or treatment period or requiring different doses of a combination of drugs. Avoidance of rigorous medication schedules can lead to decreased efficacy of the therapeutic treatment. Conversely, careless administration of medications can increase the severity of undesirable side effects and the exposure to unwarranted safety risks, including death.

Disposable pharmaceutical containers for dispensing medicaments which are used to help patients improving compliance to a medical treatment have been previously disclosed.

In order to help patients improving compliance and turn it into a patient adherence to the treatment one common approach uses indicia embossed or printed on the blister package.

US 2007015728 provides a metered-dose package for co-administration of a first and a second component of a therapeutic agent. The metered-dose package includes a first plurality of fluidly not-communicating chambers, each chamber containing an individual dose of the first component, and a second plurality of chambers, each said chamber capable of reversibly receiving at least one dose of the second component.

U.S. Pat. No. 6,375,956 relates to a disposable dispensing apparatus which provides optimal therapeutic support to humans and other animals by conveniently supplying a complex dosing regimen requiring simultaneous administration of storage-incompatible or unevenly dosed components in a shelf stable user-friendly format.

WO04089274 refers to a drug packaging, or kit, or presentation facilitating self administration of drugs by the patients, which is characterized by comprising one or more blister cards, featuring patient instruction in print form with regard to the dosage of each unit, type or mature of the active ingredient, period of the day to be taken and treatment period, among other information.

US 2004266745 discloses a blister pack for a preparations useful in hormone replacement therapy, on which a system facilitating the alternative administration of daily dosage unit, preferably as a scheme using integers from 1 to 28 to record the sequence of the particular dosage unit to be administered each day.

US2007015839 discloses a daily drug regimen for treating metabolic syndromes in a single package. The package includes doses to be taken at two different times of the day. The package can include a single day's regiment, or can include multiple days' regiment.

To help patients improving adherence to a medical treatment other approaches have been disclosed.

U.S. Pat. No. 4,627,432 relates to a device for administering medicaments to patients comprising a cylindrical chamber including a support to support a blister pack. Blisters are located in holes in the support. A plunger is arranged to enter the chamber and open a blister registered with it. When the blister is opened, medicament can be withdrawn by a patient.

U.S. Pat. No. 4,850,489 relates to dispensing packs which contain chambers with at least two solid, not mechanically connected dosage units. Where it is necessary the two pharmaceutical contained can be release at delayed intervals.

US2001030140A discloses a blister package for a pharmaceutical treatment having a plurality of individual blisters suitable for containing a pre-measured dosage of a pharmaceutical composition in the form of tablets, pills and capsules. In accordance with a pre-determined schedule of administration sealed blisters may be opened by a method of tearing, peeling and pushing.

U.S. Pat. No. 4,889,238 relates to a medicament package for improving compliance with a therapeutic regimen. The therapeutic regimen involves a plurality of medications administered to a patient in a prescribed sequence and in accordance with specified intervals. The package includes a multiplicity of blister cards carrying the medicaments in sequential order on the individual cards and from card to card. The blister cards being placed in stacked array with the principal dimensions thereof oriented generally horizontally and arranged in order of use with the first to be used topmost. Also included is a base which houses the stack of blister cards and is adapted to support the stack vertically and provides lateral support to the edges of the blister cards. The base permits direct and unobstructed access to the uppermost blister card and limited access only to the edges of the blister cards. A lid is adapted to cover the base and movable to an open position allowing access to the uppermost blister card. Each blister card generally contains indicia denoting the order and sequence when the contents of a particular blister recess are to be consumed.

WO9822072A describes a pharmaceutical package for aiding or increasing patient compliance for the administration of a specific pharmaceutical drug regimen, comprising: a) at least one blister card divided into sections separating each complex drug regimen dose; each dose comprising an indicia denoting the time in which the dose is to be administered; b) a patient information booklet comprising dosing information; c) a daily calendar comprising dosing information; and d) a reminder aid.

U.S. Pat. No. 4,254,871 relates to a packaging element for mounting blister strips containing a course of medication for a patient. The element comprises a foldable lamina divided into a supporting and a backing member with the element characterized by a plurality of apertures for receiving blisters strips. The lamina is marked to show the day of administration for the contents of each strip to improve patient compliance.

WO 03079959 relates to a tablet box for receiving and extracting tablets in a controlled manner. A commercially available blister pack can be placed directly in the tablet box, which is provided with an alarm display for the extraction of the tablets.

US 2002162769 discloses a pre-packaged, therapeutic regimen including two dosage units. Indicia for distinguishing between the first and second dosage units, administration instructions that teach the coordinated use of the dosage units, are included in the disclosed a pharmaceutical dispensing container.

EP1502568 relates to an assembly for dispensing pharmaceutical products comprising perforated plates within a housing, combined with an electronic box, where a blister pack is placed in the assembly, which lies on contacts to close a circuit and a perforated swing blade acts as a cover and blocks the blisters of the pack selectively, is new. An acoustic and visual alarm is triggered at the same time each day, according to the instructions carried by the blister pack to remind to the patient to follow the regiment.

The above discussed holders, dispensers and pharmaceutical packages are deficient in several aspects. Significantly, none of the above references present a convenient, simple and effective way of facilitating the selective access and therefore administration of substances, particularly when said substances are taken as part of a complex sequential time dependent therapeutic regimen. Further, none of the above references specifically addresses a way to facilitate simultaneous administration of prescription and non-prescription substances as part of a complex regimen. Moreover, none of the above references addresses the issue of optimizing a pharmaceutical package and helps patients improving adherence to a medical treatment. Therefore, there remains a need for a simple, inexpensive and convenient means for providing optimal therapeutic support for humans and other animals, and in particular for providing optimal support for humans and other animals having special therapeutic needs.

In addition, none of the prior art solves the problem of safety compliance in packaging. None of the prior art provides a solution to the problem of involuntary wrong uptaking of medicine, e.g. patients may access and therefore uptake drugs in a wrong sequential order.

Thus, there exists a need for a simple and effective system that increases safety and efficacy in compliance through imposition of prescribed doses at prescribed intervals for medications within a therapeutic regimen.

OBJECT OF THE INVENTION

It is an object of the present invention to provide a system for helping patients in improving compliance with a medication regime. It is a further object of the invention to provide a system for helping patients in improving safety and efficacy in compliance with a medication regime.

It is a further object of the present invention to provide an alternative to the prior art.

In particular, it may be seen as an object of the present invention to provide a system that solves the above mentioned problems of the prior art by allowing selective access to blister following a preferred opening sequence.

SUMMARY OF THE INVENTION

The present inventive subject matter is directed to a storage stable, disposable dispensing system and apparatus which provides optimal therapeutic support while overcoming the deficiencies of currently available pharmaceutical packages in a simple, effective, convenient and cost-efficient manner.

Thus, the above described object and several other objects are intended to be obtained in a first aspect of the invention by providing a system for opening a package comprising a carrier sheet with at least two separate depressions adapted to accommodate pharmaceutical compositions and at least two overlapping cover sheets each covering at least one depression, comprising elements characterized in that the access to one element is gained by removal of the preceding overlapping cover sheet and that the access to further elements is gained by sequential removal of the respectively preceding overlapping cover sheets.

The system allows for opening of packages formed by a carrier sheet including at least two depressions covered by separate cover sheets. These cover sheets overlaps in predetermined areas delimiting elements which can be gripped and peeled or torn off by pulling upwards and backwards to provide access to the relative depression located on the underneath carrier sheet. Removal of the first cover sheet by peeling or tearing off of the cover sheet or of a gripping element connected to it provides access to the first depression and to an second element which in turn can be peeled or torn off to provide access to the second depression and its content and to the second element and so on. Removal of cover sheets may be obtained in a predetermined and specific sequential way determined by the overlapping of the cover sheet delimiting the elements. This has the advantage of allowing for access to the content of the relative depressions in a desired and predetermined sequential way.

Sequential is defined as occurring in regular succession, while preceding is defined as previous following a specific spatial order, e.g. the top cover sheet precedes the immediate bottom overlapping one. Therefore, the access to the first element is gained by removal of the first cover sheet through a determined action, e.g. pull-off or tear-off, of the cover sheet or of a gripping element connected to it and access to the second element is gained by removal of the second cover sheet through a determined action, e.g. pull-off or tear-off, of the first element and so on.

The element at least partially delimited by the overlapping of the cover sheets may take the form of a tab, a strip, a snip, a notch or a flap. The element has the characteristics of being at least partially not sealed or not strongly sealed to the carrier sheet. It has the function of providing a better grip to the user for peeling off or tearing off the cover sheet and gain access to the depressions. Form, size and shape of the element are linked to its function. The element may have any form and size which allows for human or mechanical gripping. The element shape may be of any geometrical form or combination of forms, e.g. triangular, circular or square. In some embodiments the elements may have a user friendly shape, e.g. resembling a pad so as to provide a better user hold upon use.

In some embodiments the element may be made of non-slippery material, such as rubber or may have a certain degrees of surface roughness so as to provide a better grip.

The elements may be placed in different locations along the edges of the cover sheets.

In some embodiments the element is a flap which may have protrusion so as to allow a better grip. Protrusions may be embossed or printed. Protrusions my also be printed information on the flap element.

In some embodiments the package may be a blister package where the depressions take the form of blisters. In some other embodiments the package may be a blister medical package where the depressions of the carrier sheet contain a pharmaceutical composition.

The previously described object and several other objects are intended to be obtained in a second aspect of the invention by providing a blister package comprising a carrier sheet with at least two separate depressions adapted to accommodate pharmaceutical compositions and at least two cover sheets each covering at least one depression, wherein the at least two cover sheets are at least partially sealed to the carrier sheet around at least two depressions, and the at least two cover sheets overlaps and delimit at least two elements characterized in that the access to one element is gained by removal of the preceding overlapping cover sheet and that the access to further elements is gained by sequential removal of the respectively preceding overlapping cover sheets.

The blister package, e.g. a medical blister package, comprises a carrier sheet with depressions and is characterized in that the access to the element which allows admittance to the subsequent depression is hindered by the previous element, so that access to the subsequent depression is allowed only after the access to the previous depression was achieved. Dispensation of individual pharmaceutical composition is therefore allowed only following a pre-determined sequential way.

The carrier sheet of the present blister package may be made embossed, cast deep drawn or vacuum formed bases out of plastic, plastic laminates, plastic/paper laminates or plastic/metal foil laminates or metal. Non-limiting exemplary suitable plastics for carrier sheets are films and film laminates containing PVC, polyamides, polyolefins, polyesters, polycarbonates and combinations thereof. The carrier sheets may also feature a barrier layer against gases, vapours and light. Such barrier layers may be a metal foil such as an aluminium foil embedded in a plastic laminate or usefully ceramic layers or metallic layers embedded between two plastic layers. Ceramic layers may be produced by evaporating metals, oxides or nitrides of aluminium, silicon and other metals and semimetals in vacuum and depositing the substances on a plastic substrate. The methods are known as chemical vapour deposition and physical vapour deposition or sputtering. The ceramic layers may be preference contain aluminium oxides or silicon oxides or may be mixtures of various oxides, if desired also mixed with metals such as silicon or aluminium. Metal layers may be created by evaporating metals in vacuum and depositing the metals on a plastic substrate; aluminium layers may be mentioned here by way of example. The plastic substrate may be a plastic film or a plastic base made of the above mentioned plastics.

The cover sheet material may be a metal foil, such as an aluminium foil or a laminate containing aluminium foil. The aluminium foil may be replaced by a plastic foil, plastic laminates, plastic/paper laminates or plastic/metal foil laminates. The aluminium foil may be also replaced by a plastic that exhibits low elasticity and poor stretching properties. A plastic material having these properties may be obtained when large amounts of filler materials are added to the plastic.

Filler is herein defined as particles of a material which is added to plastic material to provide properties which are different in respect to the one of the plastic alone.

In some embodiments the cover sheet may comprise at least two foils, e.g. a first foil such as an aluminium foil or a laminate containing aluminium foil and a second foil such an adhesive tape. The adhesive tape has the function of removing at least part of the first foil underneath located so as to provide access to the correspondent depression following the desired sequential opening. The overlapping of the several adhesive tapes may produce the desired sequential opening on a single first foil. For example all the depressions may be covered by a single first foil, such as an aluminium foil. A series of separate adhesive tapes overlapping in predetermined areas may act as cover sheets as described above. Separate adhesive tapes may overlaps so as to delimit elements which can be gripped and peeled or torn off by pulling upwards and backwards causing the removal of the first foil, e.g. aluminium foil, covering the access to the relative depressions located on the underneath carrier sheet. Removal of the first adhesive tape by peeling or tearing off of the adhesive tape or of a gripping element connected to it causes the removal of the area of the first foil located onto the first depression; indeed providing access to the first depression. In this way a second element which in turn can be peeled or torn off causing the adhesive tape to remove the area of the first foil located onto the second depression; indeed providing access to the second depression and its content and to the second element and so on. In general sequential opening may be obtained by removal of adhesive tape in a predetermined and specific sequential way determined by the overlapping of the adhesive tapes.

The carrier sheet usually features a number of depressions in the form of cups or dishes, without limitation.

In some other embodiments the depressions in the carrier sheet may be obtained by calendering, casting, injection molding or other know thermoplastic processes. The depressions may be surrounded by a shoulder, said shoulders together forming an interconnected flat plane. The carrier sheets are prepared, for example, as an endless strip with the contents in recesses and brought together with the cover sheet material, in particular in foil form, likewise in the form of an endless strip. The cover sheets cover the carrier sheet completely and, for example, by sealing or adhesive bonding is jointed to the carrier sheet at the shoulders. The cover sheets may be sealed or adhesively bonded to the shoulders over the whole area or, by choosing a special sealing tool or bonding pattern for the purpose, this sealing or bonding may be only partial. For example, the endless strip of a carrier sheet sealed with covered sheets may be cut to the desired size. This may be performed, for example using a stamping tool. At the same time, the blister pack may have outer contours, or it is possible to provide weaknesses in the cover sheets or the carrier sheet in order to allow the blister pack to be bent or to create lid segments, making easy removal of the cover sheets and removal of the contents.

Day indicia may also be incorporated into the blister pack of the present invention. The day indicia may be of various types, without limitation. The day indicia correspond to at least two distinct depressions in the carrier sheet. For example, without limitation, the day indicia ray be a specific day of the week, such as Monday, Tuesday, Wednesday, Thursday, Friday, Saturday, Sunday or an abbreviation of said day, a specific date or a general succession of days, such as day 1, day 2, day 3, and the like. Day indicia may be indicated directly on the pharmaceutical composition or on another portion of the blister pack.

Time indicia may also be incorporated into the blister pack of the present invention. The time indicia may be of any type, without limitation. The time indicia correspond to at least two distinct time periods, but may correspond to any number of distinct time periods without limitation. For example, without limitation, the time indicia may indicate a general time of the day or a specific time of the day. Non-limiting exemplary general times of the day may be any of the following: AM, PM, morning, afternoon, evening, day, night, daytime, nighttime and combinations thereof. Each separate row or column of the present blister pack may each indicate a time of day, such as indicate AM doses and PM doses of a medicament. Predetermined area on the blister package may be colour coded for time indicia. The blister package may further include a key defining or explaining the colour coding. For example, without limitation, the area around the depression containing the pharmaceutical composition to be taken in the morning could be orange, while the areas containing the depression containing the pharmaceutical composition to be taken in the afternoon could be blue. In addition, the depression containing the pharmaceutical composition may be directly colour coded. For example, each the depression containing the pharmaceutical composition to be administered in the morning could be identified by the colour yellow and the depression containing the pharmaceutical composition to be administered at night could be identified by the colour red, without limitation. Further, each individual pharmaceutical composition could be individually colour coded for time indicia. Each depression may be made of a transparent or translucent material so that the colour coding on the pharmaceutical composition may be visible while the pharmaceutical composition is in the depression. For example, each depression containing AM doses could be collared green and be plainly visible while in the blister pack. Alternatively, the depression could be an opaque shade of colour. A colour key may be provided on the blister package to indicate which colour corresponds with which composition date or time. The indicia provide a reliable and effective feedback system in that the patient can determine if the proper dosages have been taken on the right days at the right times by comparing the indicia on the package with a calendar or clock.

The invention is particularly, but not exclusively, advantageous for providing safety in patient compliance. Since the access to the depressions containing pharmaceutical compositions is only possible following a predetermined sequential order, involuntary wrong up taking of medicine due to patient mistakes are minimized. For example, patients with sight problems, e.g. people with severe visual impairments, may not be always able to identify indicia present on the package, and therefore involuntary uptake medicine in a wrong order. With the blister package according to the invention only a predetermined and desired opening sequence is possible and therefore safety in compliance is achieved. Pharmaceutical compositions which can benefit from the advantages of the invention may also be contraceptive or medicine for chronic diseases which often require sequential uptake of tablets for optimal efficacy. The invention can provide safety in compliance as with the package according to an embodiment of the invention wrong sequential up taking due to wrong sequential opening is not achievable.

A pharmaceutical composition may comprise any biologically-active substance, without limitation. Preferably, the dosage units of the present invention comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof or combinations thereof. Non-limiting exemplary biologically-active substances of the present inventive subject matter may include thiamine, thiamine pyrophosphate, riboflavin, flavine mononucleotide, flavine adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Non-limiting exemplary derivatives of vitamin compounds include salts, alkaline salts, esters and chelates of any vitamin compound.

Pharmaceutical composition may be prescription or non-prescription substances or excipients for use in prescription or non-prescription substances. Non-limiting exemplary prescription substances include 13 C-urea (Helicobacter test), 15-Methyl-prostaglandin F1α, 1α-Hydroxyvitamin D3, 2,4-dichlorbenzylalkohol, 5-aminolevulinic acid hydrochloride, 5-aminolevulinsyre (5-ALA), abacavir, abacavir/lamivudine, abacavir/lamivudine/zidovudine, abatacept, abciximab, acamprosat, acarbose, acebutolol, acepromazin, acetaminofene, acetate, acetazolamide, acetophenazine, acetylcysteine, acetylsalicylic acid, aciclovir, acipimox, acitretin, acrivastin, acyclovir, adalimumab, adapalen, adefovir dipivoxil, adenosin, adrenalin, aesculin, agalsidase alfa, agalsidase beta, agalsidase-alfa, agalsidase-beta, agomelatin, agomelatine, alanin, albumin, humant, aldesleukin, alemtuzumab, alendronat, alendronate sodium/colecalciferol, alendronic acid/colecalciferol, alfacalcidol, alfentanil, alfuzosin, alginsyre, alglucosidase alfa, alimemazine, aliskiren, aliskiren hemifumarate/hydrochlorothiazide, alitertinoin, allopurinol, almitrin, almotriptan, alprazolam, alprenolol, alprostadil, alteplase, aluminiumaminoacetat, aluminiumhydroxid, aluminiumsaccharosesulfat, alkalic, amantadine, ambenon, ambrisentan, ambroxol, amfepramon, amidotrizoat, amiloride, aminofyllin, aminogluthetimid, aminosalyl, amiodaron, amisulprid, amitriptylin, amlodipin, amlodipine besylate/valsartan/hydrochlorothiazide, amlodipine besylate/valsartan, amlodipine/valsartan, amorolfin, amoxicillin, amphotericin B, ampicillin, amprenavir, amsachrin, amylase, amylmetacresol, anagrelide, anakinra, anastrozol, anidulafungin, antazoline, antithrombin, antithrombin alfa, antithymocytglobulin, apomorphine, apraclonidin, aprepitant, aprotinin, arcitumomab, argatroban, arginin, aripiprazole, arsenic trioxide, articain, ascorbic acid, asparagin, atazanavir, atenolol, atomoxetin, atorvastatin, atosiban, atovaquon, atropine, auranofin, aurothiomalat, aviptadil, azacitidin, azacitidine, azapropazone, azathioprin, azelaic acid, azelastine, azetazolamide, azithromycin, aztreonam, aztreonam C1-esterase-inhibitor, human, bacampicillin, bacillus Calmette Guérin (Danish strain 1331), bacillus Calmette Guérin (strain RIVM derived from strain 1173-P2), baclofen, balsalazid, bambuterol, bariumsulfat, basiliximab, bazedoxifene, becaplermin, bechlomethasone, beclometasondipropionat, benazepril, bendroflumethiaziede, bensatropine, benserazid, bensylpenicillin, benzalkonium chloride, benzene carboxylic acid, benzenmethanol, benzocain, benzoic acid, benzoylperoxid, benzydamin, benzylpenicillin, betacarotene, betahistin, betain, betaine anhydrous, betamethason, betamethason-17-valerat, betamethason-21-acetat, betamethasondipropionat, betamethasonphosphat, betanidine, betaxolol, bevacizumab, bexarotene, bicalutamid, bimatoprost, bimatoprost/timolol, biotin, biperiden, bisachodyl, bisoprololfumarat, bivalirudin, black rubber-mix (PPD-mix), bleomycin, borax, bortezomib, bosentan, botulinum toxin type a, botulinum toxin type B, brimonidin, brimonidintartrat, brinzolamide, brinzolamide/timolol, bromazepam, bromhexine, bromocriptine, brompheniramine, budesonide, bumetanide, bupivacain, buprenorphine, buprenorphine/naloxone, bupropion, buserelin, buspiron, busulfan, butylscopolamin, cabergolin, cadexomer-iodine, caffeine, cain-mix, calcipotriol, calcitirol, calcitonin, calcitonin (salmon), calcium, calciumacetate, calciumcarbonate, calciumchloride, calciumfluoride, calciumfolinate, calciumgluconate, calciumlactogluconate, calciumpolystyrensulfonate, canakinumab, candesartancilexetil, capecitabine, capsaicin, captopril, carbamazepine, carba-mix, carbetocin, carbidopa, carbimazol, carbomer, carbon, active, carboplatin, carboprost, carglumic acid, carmelloseSodium, carmustin, carvedilol, caspofungin, catumaxomab, cefalexin, cefotaxim, cefoxitin, ceftazidim, ceftriaxon, cefuroxim, celecoxib, cephaclor, cephadroxil, cephalexin, cephalotin, cephradin, certolizumab pegol, cetirizin, cetrorelix, cetuximab, chinidine, chlofibrate, chlomethiazol, chlomipramin, chlonazepam, chloprothixene, chloralhydrat, chlorambucil, chloramphenicol, chlordiazepoxid, chlorhexidine, chloride, chloriongonadotropin, chloroquin, chlorpromazine, chlorpropamid, chlorprothixen, chlorthalidon, chlorzoxazon, chlotrimazol, cholecalciferol, vitamin D3, cholinetheophyllinate, choriogonadotropin alfa, choriongonadotropin, humant (hCG), choriongonadotropin-α (hCG), chrome, ciclopirox, ciclopiroxolamin, ciclosporin, cidofovir, cilastatin, cimetidine, cinacalcet, cinchocain, cinetazon, cinnamaldehyd, cinnamylalcohol, cinnarizine, ciprofloxacin, cis (Z)-flupenthixoldecanoat, cisatracurium, cisplatin, citalopram, Cl+Me-isothiazolinon (Kathon CG), cladribin, cladribine, clarithromycin, clavulansyre, clemastin, clemastine, clindamycin, clioquinol, clobazam, clobetasolpropionat, clobetason-17-butyrat, clodronat, clofarabin, clomiphene, clomipramin, clonazepam, clonidine, clopamide, clopidogrel, clotrimazol, cloxacillin, clozapin, cobalt(II), cobber, cobber acetate, codeine, colesevelam, colestipol, colestyramin, colistimethatSodium, corticotropin, cortisone, cyanochobalamine, cyanocobalamin, vitamin B12, cyclandelar, cyclizine, cyclopentolat, cyclophenile, cyclophosphamid, cyproheptadine, cyproteron, cyproteronacetat, cysteamin, cystein, cystin, cytarabin, cytarabine, dabigatran etexilate, dacarbazine, daclizumab, dalteparin, dantron, dapson, daptomycin, darbepoetin alfa, darifenacin, darifenacin, darunavir, dasatinib, daunorubicin, deferasirox, deferiprone, deferoxaminmesilat, degarelix, demeclocycline, depreotide, desfluran, desipramin, desirudin, deslanoside, desloratadine, desloratadine (as sulphate), desmopressin, desogestrel, desoximethason, dexamethason, dexchlorpheniramine, dexibuprofen, dexketoprofen, dexpantenol, dexpanthenol, Vitamin B5, dexrazoxane, dextran 1, dextran 40, dextran 70, dextromethorphan, dextropropoxyphene, diazepam, diazoxide, diboterminalfa, dichlophenamide, diclofenac, diclofenacSodium, dicloxacillin, diculmarole, didanosin, dienogest, digoxine, dihydralazine, dihydroergotamine, dihydrogesteron, dihydrotachysterol, dihydroxyaluminium sodiumcarbonat, dikaliumchlorazepat, diltiazem, dimeglumingadopentetat, dimenhydinate, dimethylaminodiphenylbuten, dimeticon, dimeticon, ferrofumarate, dinitrogenoxid, dinoprost, dinoproston, diosmin, diphenhydramin, diphenolxylate, dipyradamol, diSodiumclodronate, diSodiumetidronate, diSodiumphosphate, disopyramide, disulfiram, dixyrazine, dobutamine, docetaxel, docosahexaenoinsyre (DHA), docusat, dofetilide, domperidon, donepezil, dopamine, doripenem, dornase alfa, dorzolamid, dosulepin, doxapram, doxazosin, doxepin, doxorubicin, doxorubicin hydrochloride, doxycyclin, doxycycline, droperidol, drospirenon, drotrecogin alfa (activated), duloxetine, dutasterid, ebastin, econazol, eculizumab, efalizumab, efavirenz, efavirenz/emtricitabine/tenofovir disoproxil (as fumarate), eflornithine, eicosapentaenoinsyre (EPA), ekonazol, eletriptan, emedastine, empron, emtricitabine, emtricitabine/tenofovir disoproxil, enalapril, enfuvirtide, enoxaparin, entacapone, entecavir, ephedrine, epinephrine, epirubicin, eplerenon, epoetin alfa, epoetin beta, epoetin delta, epoetin zeta, epoprostenol, epotermin alfa, epoxyresin, eprosartan, eptacog alfa (activated), eptifibatid, eptifibatide, eptoterminalfa, erdostein, ergocalciferol, vitamin D2, ergotamine, erlotinib, erlotinib, ertapenem, erythromycin, escitalopram, eslicarbazepin, eslicarbazepine acetate, esmolol, esomeprazol, estradiol, estradiolvalerat, estradiolvalerianate, estramustin, estramustinphosphat, estriol, etambutol, etanercept, etanercept, ethacrynacide, ethambutol, ethinylestradiol, ethosuximide, ethylendiamin, ethylmorphine, etidronat, etilephrine, etodolac, etonogestrel, etoposide, etoricoxib, etravirin, etravirine, etulos, eugenol, everolimus, exemestan, exenatid, exenatide, ezetimibe, ezlocillin, factor IX, factor VIII, famciclovir, febuxostat, felodipin, felypressin, fenoterol, fentanyl, fentanyl citrate, ferri-salts, ferritetrasemisodium, ferro-salts, ferrosuccinate, ferumoxsil, fesoterodine, fexofenadin, fibrinogen, fibronektin, filgrastim, finasterid, fiskeolie, flavoxat, flecainide, flucloxacillin, fluconazol, flucytosin, fludarabinphosphat, fludrocortison, fludrocortisonacetat, flumazenil, flumedroxon, flumetasonpivalat, flunarizin, flunitrazepam, fluocinolonacetonid, fluocinonid, fluocortolon 21-pivalat, fluorid, fluormetolon, fluoruracil, fluoxetin, fluoximesteron, flupentizol, fluphenazindecanoat, fluphenazine, flurbiprofen, flutamid, fluticasone furoate, fluticasonpropionat, fluvastatin, fluvoxamin, folic acid, folic acid heparin, follitropin alfa, follitropin beta, follitropin-α (rfSH), follitropin-β (rfSH), fomivirsen, fondaparinux, fondaparinux sodium, formaldehyde, formoterol, fosamprenavir, fosaprepitant, fosaprepitant dimeglumine, fosinoprilSodium, fosphenytoin, framycetin, frangulabark, frovatriptan, fulvestrant, furosemide, fusidic acid, gabapentin, gadobutrol, gadodiamid, gadofosveset, gadoteridol, gadoterinsyre, gadoversetamide, galantamin, galsulfase, ganciclovir, ganirelix, gefitinib, gelatine, gemcitabin, gemeprost, gemfibrozil, gentamicin, geraniol, gestoden, glatirameracetat, glibenclamid, gliclazid, glimepirid, glipizid, glucagon, glucopyrron, glucosamin, glucose, glutamin, glutathion, glycerol, glycerophosphat, glyceryl nitrate, glycerylnitrate, glyceryltrinitrate, glycin, glycopyrron, glycylglutamin, glycyl-tyrosin, golimumab, goserelin, gramicidin, granisetron, griseofulvin, guanetidine, guanfacine, haloperidol, heparin, heparin co-factor, heparinoid, hesperidin, hexaminolevulinat, histamine, histidine, histrelin, human coagulation factor IX, human fibrinogen/human thrombin, human normal immunoglobulin, human normal immunoglobulin (IVIg), hydralazine, hydrochloride, hydrochlorthiazide, hydrocortisonacetat, hydrocortisone, hydrocortisone-17-butyrat, hydrocortisonsuccinat, hydrogenperoxid, hydromorphon, hydroxichloroquine, hydroxiprogresterone, hydroxizine, hydroxocobalamin, vitamin B12, hydroxycarbamide, hydroxychloroquin, hydroxycitronellal, hydroxyethylrutosider, hydroxyethylstivelse starch, hydroxyurea, hyoscin, hyoscinbutylbromid, hyoscyamine, hypromellose, ibandronic acid, ibandronsyre, ibritumomab tiuxetan, ibuprofen, icatibant, ichthammol, icodextrin, idarubicin, idursulfase, ifosfamid, iloprost, imatinib, imatinib mesilate, imiglucerase, imipenem, imipramin, imiquimod, immunglobulin G, humant, immunglobulin, humant (anti-D), indapamid, indinavir, indomethacine, infliximab, inositolnico-tinate, insulin, insulin aspart, insulin aspart protamin, insulin detemir, insulin glargine, insulin glulisine, insulin human (rDNA), insulin lispro, insulin lispro protamin, insulin, humant, insulin, isophan, humant, interferon alfa-2b, interferon alfacon-1, interferon beta-1a, interferon idoxuridin, interferon-alfa, interferon-alfa-2b, interferon-beta-1a, interferon-beta-1b, interferon-gamma-1b, interleukin-2, iobitridol, iodidine, iodixanol, ioflupane (123 I), iohexol, iomeprol, iopromid, iotrolan, ioversol, ipratropium, irbesartan, irbesartan/hydrochlorothiazide, irinotecan, isocarboxazid, isoeugenol, isofluran, isoleucin, isoniazid, isophaninsulin, humant, isoprenaline, isosorbiddinitrate, isosorbidmononitrate, isotretinoin, isradipin, itraconazol, ivabradine, ketobemidon, ketobemidone, ketokonazol, Ketoprofen, ketorolac, ketotifen, Kolofon, kreatinin monohydrate, kreatinin monohydrate, labetalol, lacidipin, lacosamide, lactat, lactic acid, lactic acid producing bacteria, lactulose, lamivudine, lamivudine/zidovudine, lamotrigin, lanolin, lanreotid, lansoprazol, lanthanum, lapatinib, laronidase, laropiprant, lasofoxifene, latanoprost, lecithin, leflunomide, lenalidomide, lenograstim, lepirudin, lercanidipin, letrozol, leucin, leucovorin, leuprorelin, levetiracetam, levocabastin, levocetirizin, levodopa, levofloxacin, levofolic acid, levomepromazine, levonorgestrel, levotyroxin, lidocain, lincomycin, linezolid, liotyronin, lipase, liraglutide, lisinopril, lithiumcarbonat, lithiumcitrat, Iodoxamid, lofepramin, lomustine, loperamide, lopinavir, loratadin, lorazepam, lormetazepam, lornoxicam, losartan, lovastatin, lutropin alfa, lymecycline, lynestrenol, lypressin, lysine, macrogol 3350, magnesium, magnesium carbonate, magnesium chloride, magnesium hydroxide, magnesiumoxide, magnesiumsulfate, malathion, mangafodipir, mangane, mannitol, maptrotilin, maraviroc, mebendazol, mebeverin, mecasermin, mecillinam, meclozine, medroxiprogresterone, medroxyprogesteronacetate, mefloquine, mefruside, megesterol, megestrolacetat, melatonin, melfalan, meloxicam, melperon, melphalan, memantine, meningokokpolysaccharid, menotropin (hmG), mepensolar, mepivacain, meprobamat, mepyramin, mercaptamine bitartrate, mercaptobenzothiazol, mercapto-mix, mercaptopurin, meropenem, mesalazin, mesna, mesterolon, mestranol, metacycline, metaoxedrin, metenamine, metformin, meth Idopa, methadone, methenamin, methionin, metholazone, methotrexat, methoxy polyethylene glycol-epoetin beta, methylaminolevulinat, methyldopa, methylergometrin, methylergotamine, methylnaltrexon, methylnaltrexone bromide, methylperon, methylphenidat, methylprednisolon, methylprednisolonacetat, methylprednisolonsuccinat, methylscopolamine, methyprylon, metixene, metoclopramide, metopimazin, metoprolol, metronidazole, metychlothiazide, mexiletin, mianserin, micafungin, miconazole, midazolam, mifamurtide, miglustat, minoxidil, mirtazapin, misoprostol, mitomycin, mitotane, mitoxantron, mivacurium, moclobemid, modafinil, molybdenum, mometasonfuroat, moroctocog alfa, morphine, moxaverine, moxifloxacin, moxonidin, mupirocin, mycophenoic acid, mycophenolate mofetil, nabumeton, nadolol, nafarelin, nalbuphin, nalidixic acid, naloxone, naltrexon, nandrolon, naphazolin, naproxen, naratriptan, natalizumab, natamycine, nateglinide, nebivolol, nelarabin, nelarabine, nelfinavir, neomycin, neomycinsulfat, neostigmin, nepafenac, nevirapine, nicheritrol, nickel, nicomorphin, nicorandil, nicotin, nicotinamid, nicotinic acid, nicotinic acid/laropiprant, nicotinyl alchol, nifedipine, nilotinib, nimodipin, niphedipin, nitisinone, nitrazepam, nitrendipin, nitric oxide, nitrofurantoin, nitrogen, nitrogen oxide, nitroprusside, nizatidin, nonacog alfa, noradrenalin, norelgestromin, norelgestromin/ethinyl estradiol, norethisteronacetat, noretisterone, norfloxacin, norgestimat, nortriptylin, noscapine, nystatin, oak moss, octocog alfa, octreotid, ofloxacin, olanzapine, olmesartanmedoxomil, olopatadine, olsalazin, omalizumab, omeprazol, ondansetron, opipramol, opium, oral Cholera vaccine, orciprenaline, orlistat, ornidazol, ornithin, orphenadrine, oseltamivir, osteogent protein-1: BMp-7, oxaliplatin, oxazepa, oxazepam, oxcarbazepin, oximetolon, oxiphencyclimine, oxitetracycline, oxprenolol, oxybutynin, oxycodon, oxygen, oxymetazolin, oxytetracyclin, oxytocin, paclitaxel, paclitaxel albumin, palifermin, palifermin, paliperidone, palivizumab, palonosetron, pamidronat, panitumumab, pantoprazole, pantotenol, vitamin B5, pantothenic acid, papaverine, paracetamol, paraffinolie, parathyroid hormone (rDNA), parecoxib, paricalcitol, paroxetin, pegaptanib, pegaptanib sodium, pegfilgrastim, peginterferon alfa-2a, peginterferon alfa-2b, pegvisomant, pegylated interferon-alfa-2a, pegylated interferon-alfa-2b, pemeterxed, penciclovir, penfluridol, penicillamine, pentaeritrityltetranitrate, pentazocine, pentobarbital, pentoxifyllin, pentoxiverine, perflutren, pergolid, periciazin, perindopril, permethrin, perphenazindecanoat, perphenazine, pertussistoksoid, pethidin, pethidine, phenazone, phenazonsalicylat, phenemal, phenfluramin, phenobarbital, phenoperidine, phenoxymethylpenicillin, phenprocoumon, phentanyl, phentolamin, phenylamine, phenylbutazone, phenylephrin, phenylpropanolamine, phenytoine, phosphat, phosphestrol, phytomenadion, vitamin K1, phytominadion, pilocarpin, pimecrolimus, pimozid, pindolol, pioglitazone, pioglitazone/glimepiride, pioglitazone/metformin, pioglitazone/metformin hydrochloride, pipamperon, piperacillin, piritramide, piroxicam, pivampicillin, pivmecillinam, pizitifen, pizotifen, plasminogen, plerixafor, podophyllotoksin, polydocanol, polyestradiolphosphat, polygelin, polymyxin B, polythiazide, posaconazole, potassium, potassium acetate, potassium chloride, potassium dihydrogen phosphate, potassium dikromat, potassium hydroxide, potassium phosphate, p-phenylendiamin, pramipexole, prasugrel, pravastatin, prazosine, prednisolon, prednisolon sodiumphosphate, prednisone, pregabalin, prenalterol, prilocaln, primidone, probanteline, probenecid, procain, procainamide, procarbazine, prochlorperazine, procylidine, proetazine, progesteron, proguanil, prolin, promethazine, propafenon, propanthelinbromid, propionmazine, propofol, proproanolol, propylthiouracil, propyphenazon, proscillaridin, protamin, protein C, protein C, human, protein S, protriptylin, proxiphylline, prucalopride, pseudoephedrine (as sulphate), p-t-butylphenolformaldehyd-resin, pyrazinamid, pyridostigmine, pyridoxin, pyridoxin, Vitamin B6, pyrityldion, pyrvin, quetiapin, quinagolid, quinapril, quinin, quinolin-mix, rabeprazol, raffinose, raloxifene, raltegravir, ramipril, ranibizumab, ranitidine, ranolazine, rasagiline, rasburicase, reboxetin, recombinant human erythropoietin alfa, remifentanil, repaglinide, reserpine, resorcinol, retapamulin, reteplase, retinol, retinol, vitamin A, ribavirin, riboflavin, vitamin B2, rifabutin, rifampicin, riiterol, rilonacept, riluzole, rimexolon, rimonabant, risedronat, risperidon, ritonavir, rituximab, rivaroxaban, rivastigmine, rizatriptan, rocuronium, romiplostim, ropinirol, ropivacain, rosiglitazone, rosiglitazone/glimepiride, rosiglitazone/metformin, rosuvastatin, rotavirus, rotigotine, roxithromycin, rufinamide, sagradaextract, salazosulfapyridin, salazosulfapyridine, salbutamol, salicylic acid, salicylic amide, salmeterol, samarium [153sm] lexidronam pentasodium, sapropterin, saquinavir, saxagliptin, scopolamine, selegilin, selenium, selenium disulfid, sennaglycosides, serin, sertindol, sertralin, sevelamer, sevelamer (carbonate), sibutramin, sildenafil, simeticon (aktiveret dimeticon), simvastatin, sirolimus, sitagliptin, sitagliptin/metformin hydrochloride, sitagliptin phosphate monohydrate/metformin hydrochloride, sitaxentan, sitaxentan sodium, s-ketamin, sodium oxybate, sodium phenylbutyrate, sodium-chromoglicate, sodiummaurothiomalate auronofin, sodiumpicosulfat, solifenacin, solvsulfadiazin, somatotropin, somatrem, somatropin, sorafenib, sorbitol, sotalol, spectinomycin, spiramycin, spironolactone, stanozolol, stavudine, stiripentol, streptokinase, strontium ranelate, sucralfat, sufentanil, sugammadex, sulbentin, sulesomab, sulfamethizol, sulfamethoxazol, sulfasalazin, sulfat, sulfisomidine, sulphur hexafluoride, sulpirid, sumatriptan, sunitinib, suxamethon, synstigmine, tacrolimus, tadalafil, tafluprost, tamoxiphene, tamsulosin, tasonermine, taurin, tazobactam, tegafur, teicoplanin, telbivudine, telithromycin, telmisartan, telmisartan/hydrochlorothiazide, temoporfin, temozolomide, temsirolimus, tenecteplase, teniposide, tenofovir disoproxil, tenoxicam, terazosin, terbinafin, terbutalin, teriparatide, terlipressin, terodiline, testosterone, testosteronenantat, testosteronundecanoat, tetanustoksoid, tetrabenazin, tetracosactid, tetracycline, tetryzolin, thalidomide, theophlline, theophyllin og ethylendiamin, thiamazol, thiamin, vitamin B1, thiethylperazine, thioguanine, thiomersal, thiopental, thioridazine, thiotepa, thithixen, threonin, thrombin, human, thyrotropin alfa, tiagabin, tiamazol, tiamin, tiaprofenic acid, tibolon, tigecyclin, tigecycline, timolol, tinidazole, tinzaparin, tiotropium, tipranavir, titandioxide, tizanidin, tobramycin, tocilizumab, tocofersolan, tocopherol, vitamin E, tokoferol, tolazamid, tolbutamid, tolcapone, tolfenamic acid, tolterodin, tolvaptan, topiramat, topotecan, toremifene, trabectedin, tramadol, trandolapril, tranexamic acid, trastuzumab, travoprost, travoprost, travoprost/timolol, treosulfan, treprostinil, triacelluvax, triamcinolonacetonid, triamcinolonhexacetonid, triazolam, trifluoperazine, triglycerid, trimetazidin, trimethaphan, trimethoprim, trimipramin, triptorelin, trombin, tropicamid, tropisetron, trospiumchlorid, tryptophan, tyrotropin, ulipristal, ulipristalacetat, urofollitropin (uFSH), urokinase, ustekinumab, valaciclovir, valdecoxib, valganciclovir, valin, valproat, valsartan, vancomycin, vardenafil, vareniclin, varenicline tartrate, vasopressin, venlafaxin, verapamil, verteporfin, vigabatrin, vildagliptin, vildagliptin/metaformin hydrochloride Idagliptin, vildagliptin/metformin hydrochloride, vinblastin, vinchristin, vindesin, vinflunine ditartrate, vinorelbin, zonisamide, zopiclon, zuclopenthixol, zuclopenthixolacetat, zuclopenthixoldecanoat, zuclopentizol, α1-proteinaseinhibitor (human), α-amylcinnamaldehyd and combinations thereof. Pharmaceutical composition may be prescription or non-prescription substances such as vaccines. Non-limiting exemplary vaccines can be characterised viable autologous cartilage cells expanded ex vivo expressing specific marker proteins, combined diptheria, tetanus, acellular pertussis and hepatitis B recombinant vaccine, combined hepatitis A and hepatitis B vaccine, diphtheria, tetanus, pertussis, hepatitis B, Haemophilus influenzae type b conjugate vaccine, Diphtheria, tetanus, whole cell pertussis and hepatitis B vaccine, diptheria, tetanus, acellular pertussis, hepatitis B recombinant (adsorbed), inactivated poliomyelitis and absorbed conjugate haemophilus influenzae type b vaccine, diptheria, tetanus, acellular pertussis, hepatitis B recombinant (adsorbed), inactivated poliomyelitis vaccine, haemophilus b conjugate (Meningoccocal Protein conjugate) and hepatitis B (recombinant) vaccine, hepatitis A (inactivated), hepatitis B(rDNA) (HAB) antigen vaccine (adsorbed), hepatitis B (rDNA) vaccine (adjuvanted, adsorbed), hepatitis B (Recombinant) Vaccine, human papillomavirus vaccine, human papillomavirus vaccine [types 6, 11, 16, 18] (recombinant, adsorbed), human rotavirus, live attenuated, Inactivated Hepatitis A virus HBsAg recombinant purified, influenza vaccine (split virion, inactivated), Influenza vaccine (surface antigen, inactivated, prepared in cell culture), Japanese Encephalitis Vaccine (inactivated, adsorbed), measles, mumps and rubella vaccine (live), measles, mumps, rubella and varicella vaccine (live), Pandemic influenza vaccine, Pandemic influenza vaccine (H1N1) (split virion, inactivated, adjuvanted); A/California/7/2009 (H1N1)v like strain (X-179A), Pandemic influenza vaccine (surface antigen, inactivated, adjuvanted); A/California/7/2009 (H1N1)v like strain (X-179A), pandemic influenza vaccine (whole virion, vero cell derived, inactivated) pneumococcal polysaccharide conjugate vaccine (adsorbed), pneumococcal saccharide conjugated vaccine, absorbed, prepandemic influenza vaccine (H5N1) (split virion, inactivated, adjuvanted) A/Vietnam/1194/2004 NIBRG-14, rotavirus vaccine, shingles (herpes zoster) vaccine (live) and combinations thereof.

Non-prescription substances can be a vitamin or derivative thereof, or a mineral compound or derivative thereof. The vitamin or mineral compound may be thiamine, thiamine pyrophosphate, riboflavin, flavine mononucleoride, flavine adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Derivatives of vitamin compounds include salts, alkaline salts, esters and chelates of any vitamin compound, without limitation. The non-prescription substances can also be a herbal compound, herbal extract, derivative thereof or combinations thereof, without limitation.

Pharmaceutical composition may take any form, and combinations thereof. Examples of such forms include, without limitation, chewable tablet, quick dissolve tablet, effervescent tablet, reconstitute powder, elixir, liquid, solution, suspension, emulsion, tablet, multi-layer tablet, bi-layer tablet, capsule, soft gelatine capsule, hard gelatine capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatine, cereal, cereal coating, animal feed or combinations thereof. The preparation of any of the above forms may be performed by techniques and methods well known and readily available to persons of ordinary skill in the art.

The previously described object and several other objects are intended to be obtained in a third aspect of the invention by providing a method for accessing items in a sequential order comprising: providing a blister package according the second aspect of the invention and administering to an animal.

Animal is herein defined as referring to all members of the kingdom animalia including humans.

In some embodiment according to the third aspect of the invention the animal is a female human, e.g. pregnant, lactating, menopausal, woman preparing to conceive a child or using contraceptive compositions.

The method of the present invention may be used by any human or other animal. The present method is particularly suitable for individuals with special therapeutic needs or specific therapeutic needs, particularly where those needs would benefit from a complex therapeutic regimen. For example, without limitation, the present method is particularly suitable for menopausal women, lactating women, pregnant women, men or women planning to conceive a child, individuals suffering from a pathological condition or any combination of the above.

The present inventive subject matter includes a method for providing optimal therapeutic support to an animal by increasing compliance with a complex dosing regimen and facilitating simultaneous administration of storage-incompatible substances. The present inventive subject matter also encompasses a method for increasing patient compliance with prescription therapeutic substances.

The prescription substance may be, without limitation, a hormone replacement agent, a contraceptive agent, an osteoporotic agent, a chemotherapeutic agent, an anti-infective agent, an analgesic, a steroid, an appetite suppressant, a weight loss agent, a tobacco antagonist, a cholesterol reducer or combinations thereof. The prescription therapeutic substance may be a therapeutic regimen is a complex daily therapeutic regimen.

The methodology of the present inventive subject matter is not strictly limited to blister package. Any conventional pharmaceutical container(s) having structural similarity to blister package are suitable. Non-limiting exemplary containers include tubes, canisters, packets and the like.

The invention being thus described, it will be apparent that the same may be varied in many ways. Such variations are not to be regarded as a departure from the spirit and scope of the invention, and all such modifications are intended to be within the scope of the appended claims.

The methods of the invention may also comprise providing indicia on the blister package according to the second aspect of the invention.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The first, second and third aspect of the present invention may each be combined with any of the other aspects. These and other aspects of the invention will be apparent from and elucidated with reference to the embodiments described hereinafter.

In the following, a number of preferred and/or optional features, elements, examples and implementations will be summarized. Features or elements described in relation to one embodiment or aspect may be combined with or applied to the other embodiments or aspects where applicable. As an example, a feature or element described in relation to the opening system may be implemented as a step in the method where appropriate. Also, explanations of underlying mechanisms of the invention as realized by the inventors are presented for explanatory purposes, and should not be used in ex post facto analysis for deducing the invention.

BRIEF DESCRIPTION OF THE FIGURES

The system according to the invention will now be described in more detail with regard to the accompanying figures. The figures show some way of implementing the present invention and is not to be construed as being limiting to other possible embodiments falling within the scope of the attached claim set.

DETAILED DESCRIPTION OF EMBODIMENTS

Figure 1:
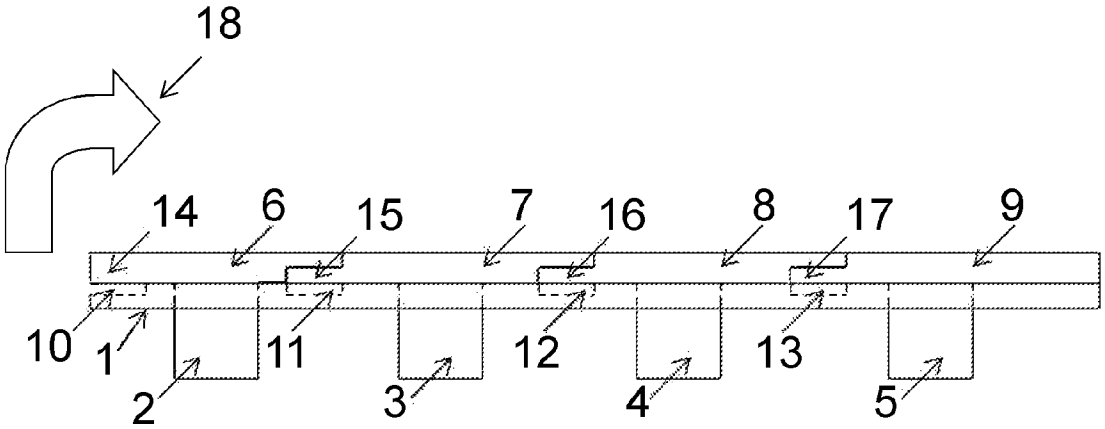
FIG. 1 shows a side view of a blister package according to one embodiment of the invention.

FIG. 1 shows a side view of a blister package according to one embodiment of the invention. The blister package is shown containing a number of 4 depressions in its carrier sheet. This is simply for descriptive reasons and should not be considered as a limitation to the scope of protection. Any commercially practicable number of depressions may be produced into a single blister package.

The blister package is characterized by a carrier sheet 1 in which at least two but preferably a plurality of depression 2-5 of the carrier sheet 1, extending from the plane of the carrier sheet 1 are present to house pharmaceutical compositions in different forms, e.g. capsule, tablets or pills.

The blister package also includes a number of cover sheets 6-9 at least partially sealed to the carrier sheet 1 and around the respective depressions 2-5, with the function of regulating access to the depressions 2-5 housing pharmaceutical compositions.

The cover sheets 6-9 are characterized in that the previous sheet partially overlap the following one so as to provide a predetermined and sequential access to the depressions 2-5 and therefore to the pharmaceutical compositions therein contained.

In some other embodiments (not shown) previous cover sheets fully overlap the following ones.

The carrier sheet 1 may also have one or more recesses 10-13 being adjacent to each respective depression 2-5. In FIG. 1 the first recess 10 is shown as a stepped recess with the function of leaving a small portion of the edge of the cover sheet 6 unsealed. Thus a tab 14 is created.

By gripping the tab 14 of the cover sheet 6 and by peeling or tearing tab 14 off the cover sheet 6 is pulled upwards and back following arrow 18 and therefore removed providing access to the first depression 2 containing a pharmaceutical composition.

Figure 1A:
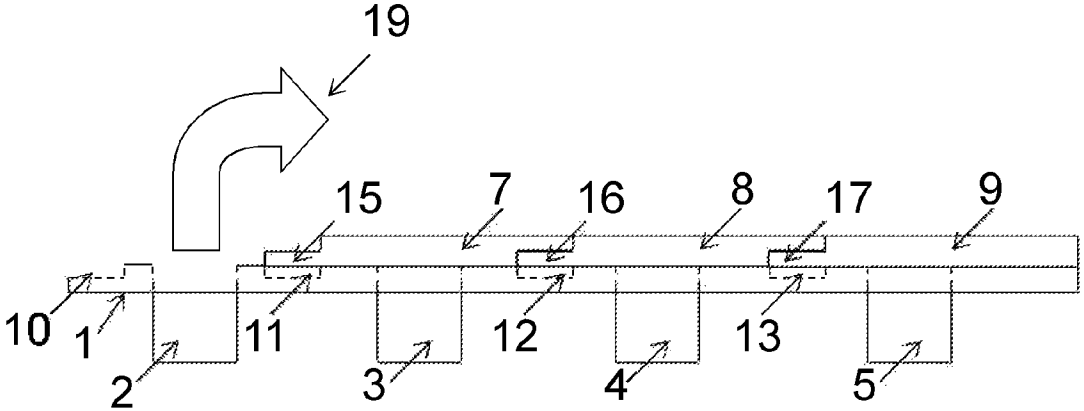
FIG. 1*a* shows a side view of a blister package according to one embodiment of the invention after the removal of the first opening element, allowing access to the first depression.

Upon removal of the cover sheet 6, as shown in FIG. 1*a*, depression 2 is open and access to the tab 15, i.e. the overlapping area between cover sheet 6 and 7, for removing cover sheet 7 is obtained. A second recess 11 may be present to allow for gripping of tab 15 so that by peeling or tearing tab 15 off the cover sheet 7 is pulled upwards and back following arrow 19 and cover sheet 7 is removed providing access to depression 3 and so on.

While shown as an indentation into the carrier sheet in this example recess areas may have different shapes and forms.

In another embodiment one or more recesses may be not present so that gripping of cover sheets may be made feasible by leaving a small portion of the cover sheet unsealed around part of the edges of the respective depressions. The small portion may generally correspond to the overlapping area between the cover sheets or to the tab present in the previous cited embodiment.

Figure 2:
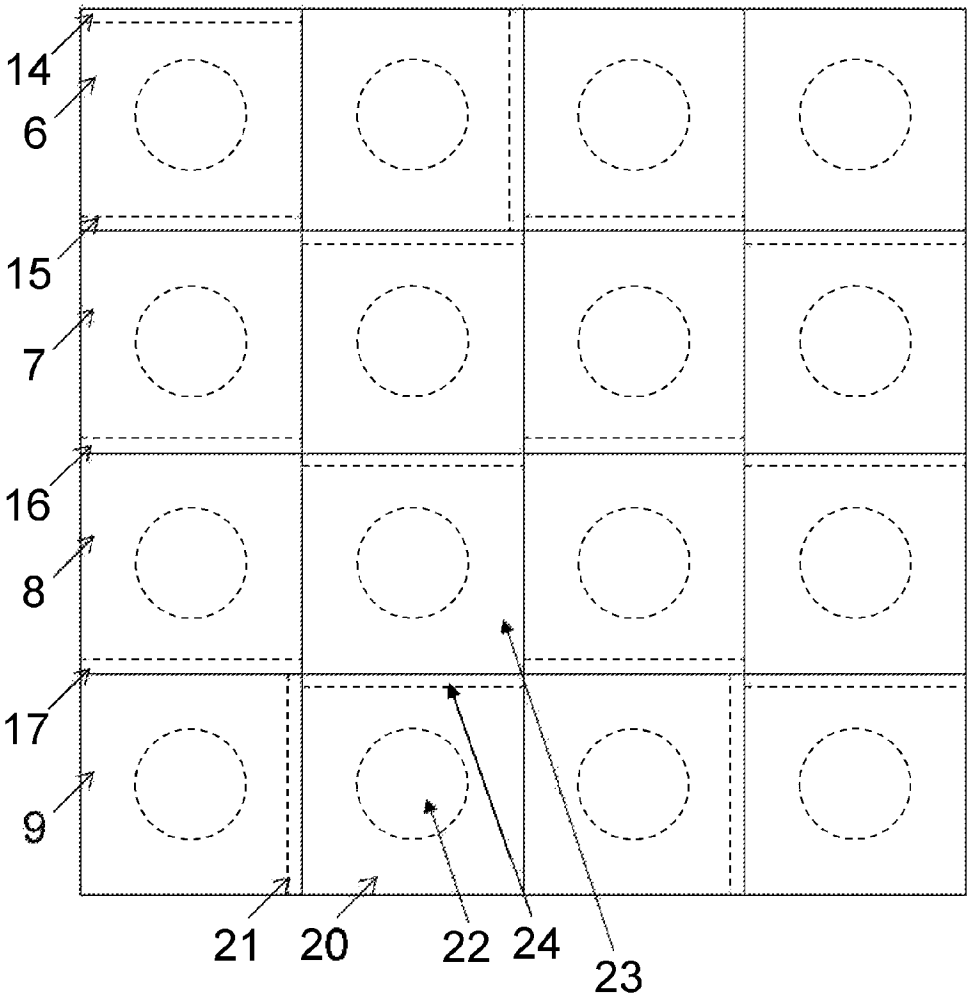
FIG. 2 shows a front view of a blister package according to one embodiment of the invention.

FIG. 2 shows a blister package according to one embodiment of the invention.

Figure 2A:
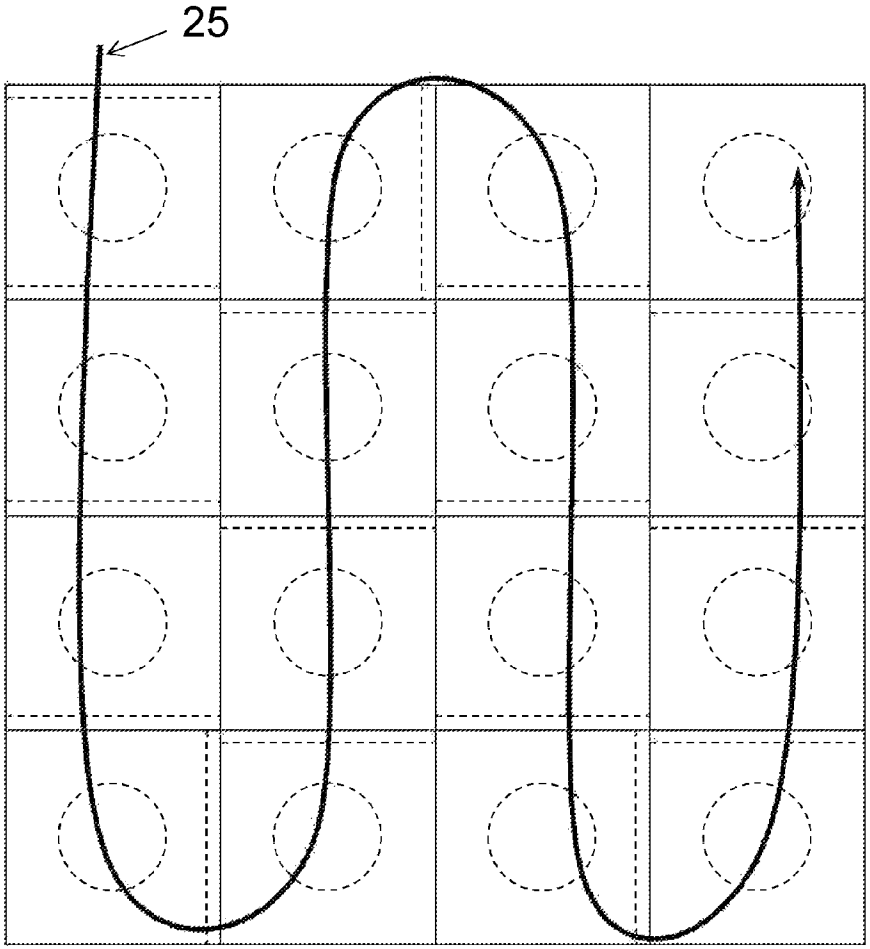
FIG. 2*a* shows the sequence of opening according to the embodiment of the invention in FIG. 2.

While in this embodiment 16 depressions are shown, this is simply for descriptive reasons and should not be considered as a limitation to the scope of protection. Any commercially practicable number of depressions may be produced into a single blister package. FIG. 2 shows the front view of the package of FIG. 1. The access to the different depressions is gained in a sequence that can be predetermined by providing a specific overlapping of the cover sheets. As shown by FIGS. 1 and 1*a* the overlapping areas 15-17 between the cover sheets 6-9 determine the sequence of access. FIG. 2 shows also cover sheet 20 and tab 21. Cover sheet 9 hinders access to tab 21, so that to the removal of cover sheet 9 follows the removal of cover sheet 20 allowing access to depression 22. Accordingly cover sheet 23 can be removed by peeling or tearing off tab 24, which can be accessed only following removal of cover sheet 20. In FIG. 2*a* the sequence of access to the several depressions, following arrow 25 is obtained by using an overlapping between cover sheets and tab as shown in FIG. 2.

Figure 2B:
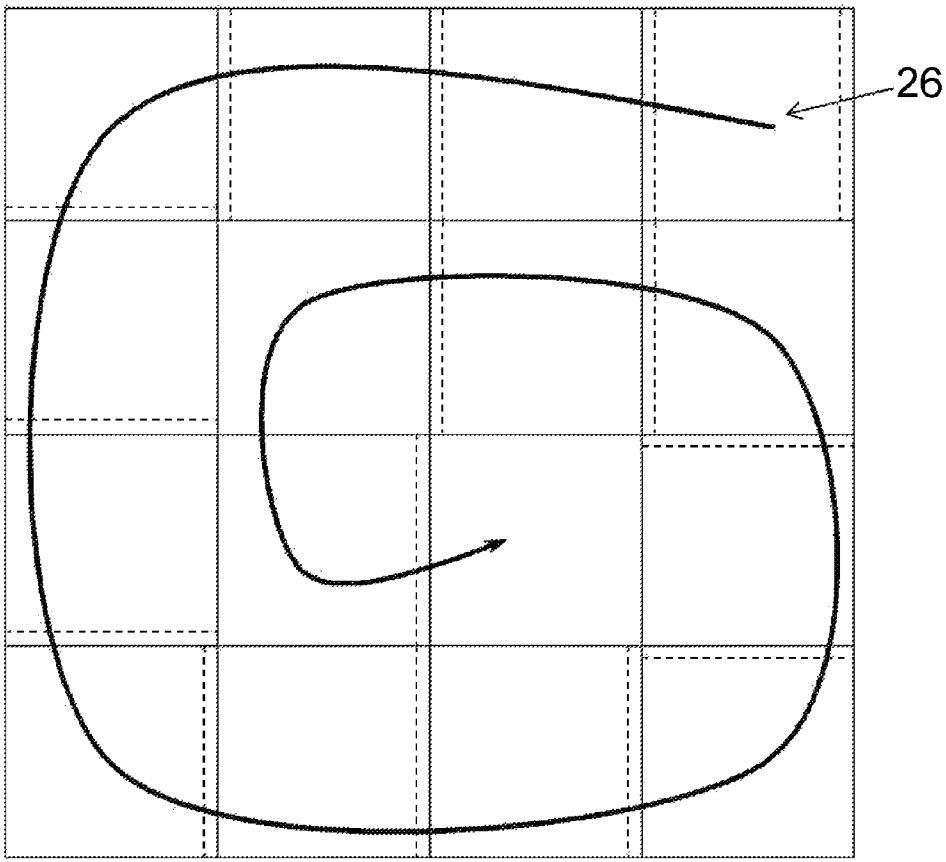
FIGS. 2*b*, 2*c* and 2*d* show other embodiments according to the invention having a different opening sequence.
Figure 2C:
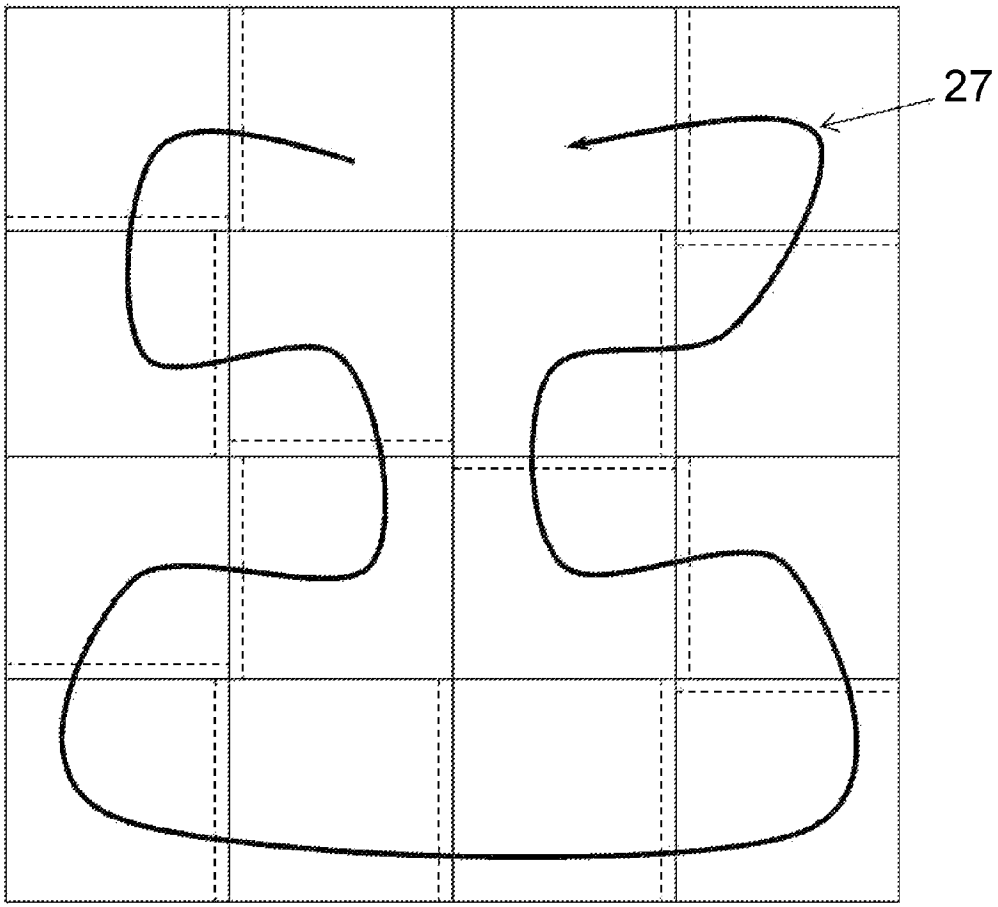
Figure 2D:
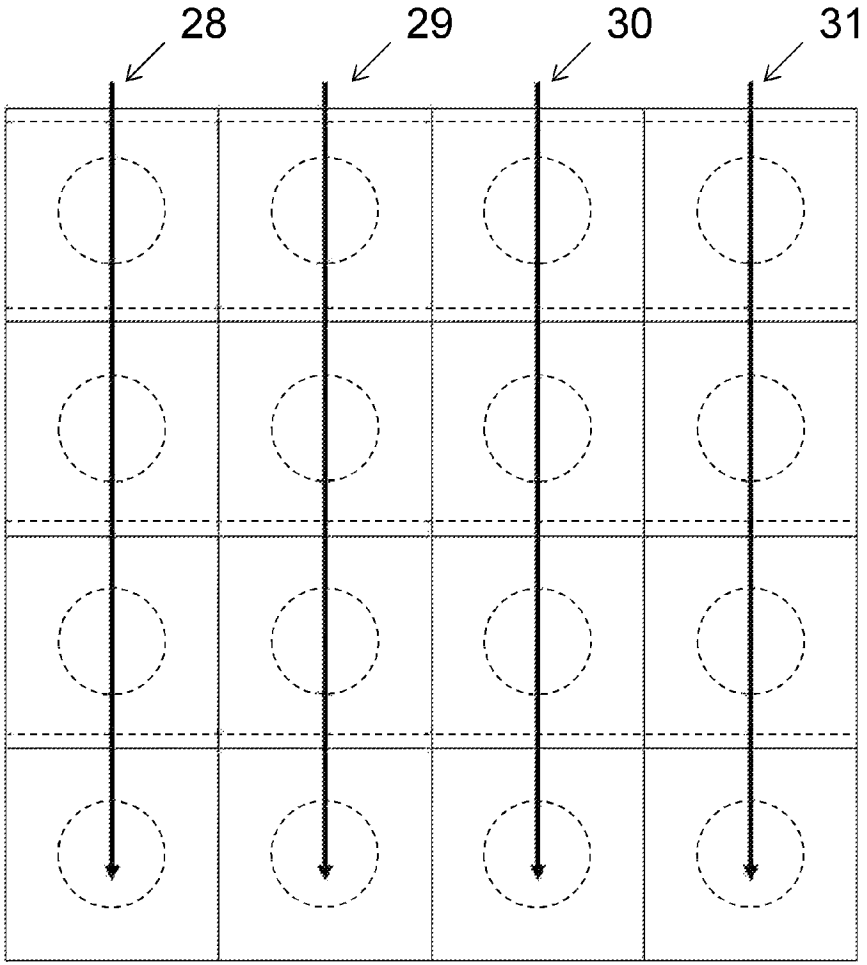

Several opening direction may be obtained by predetermined overlapping sequence, e.g. round, zig-zag, up-down, left-right. Two examples are shown in FIG. 2*b* and FIG. 2*c* following arrow 26 and 27 respectively. A third example showing multiple staring points, indicated by arrows 28-31 is shown in FIG. 2*d*.

Figure 3:
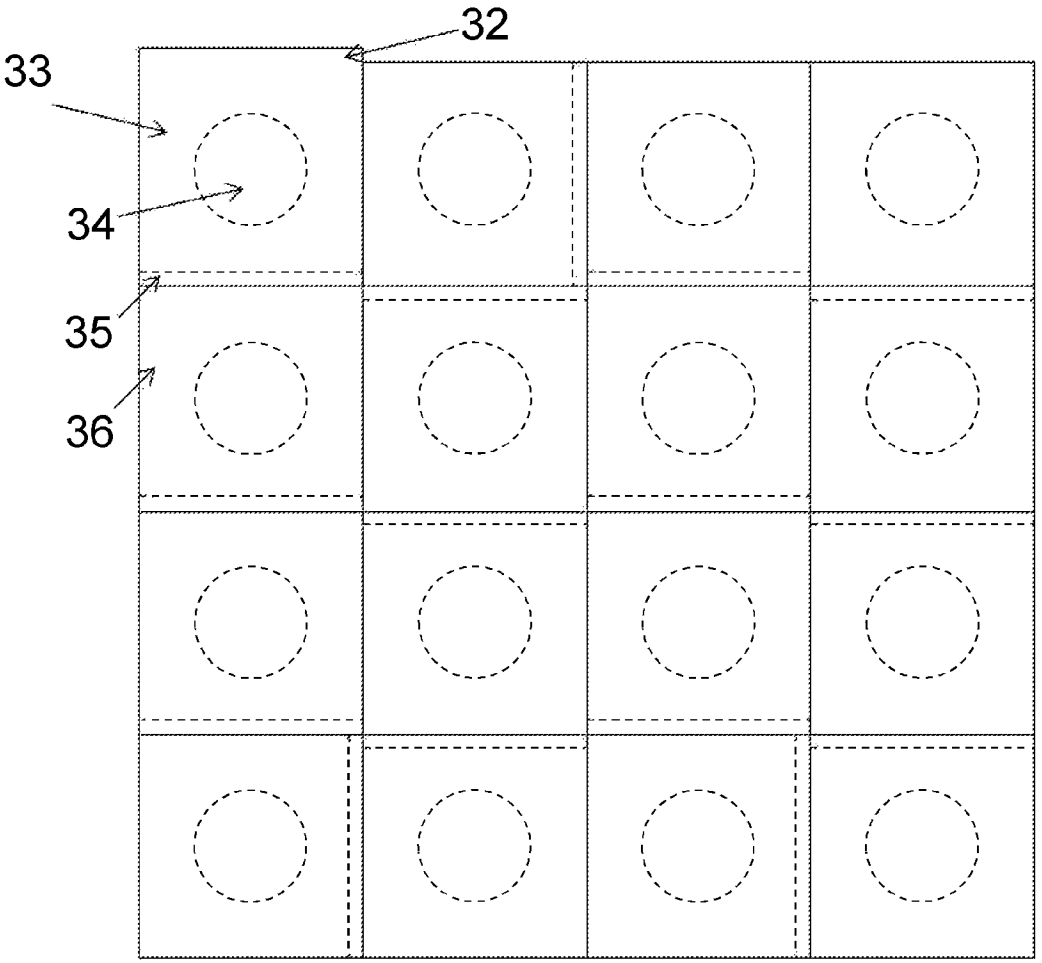
FIG. 3 shows a front view of a blister package according to another embodiment of the invention.
Figure 4:
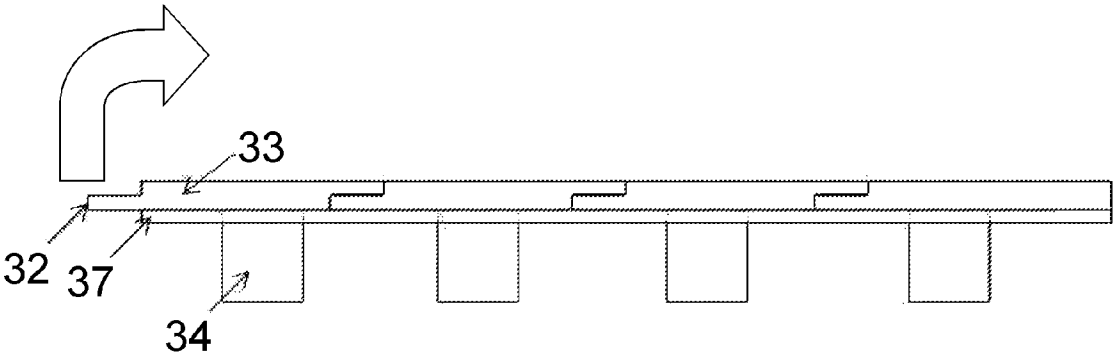
FIG. 4 shows a side view of a blister package according to another embodiment of the invention.

FIG. 3 shows a blister package according to another embodiment of the invention where the first cover sheet 33 has tab 32 which extends over the edge of the carrier sheet 37 (FIG. 4). This allows for patient grip without the need of a recess.

In another embodiment the patient grip of the first cover sheet of the blister package may be achieved by using a cover sheet which does not extend beyond the carrier sheet edge and by leaving part of the cover sheet partially unsealed along its edge.

Figure 4A:
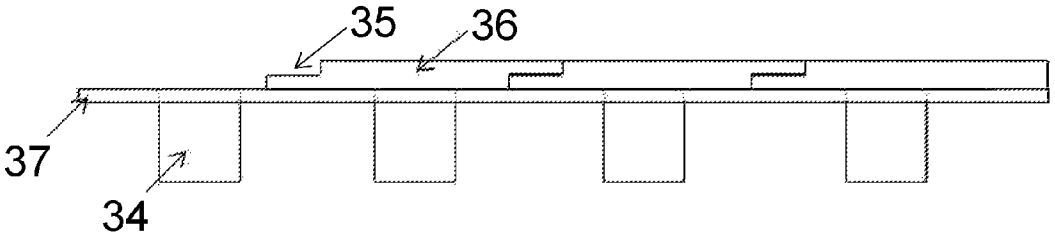
FIG. 4*a* shows a side view of a blister package according to one embodiment of the invention after the removal of the first cover sheet, allowing access to the first depression.

Similarly as shown in the previous embodiment, access to depression 34 is obtained by removal of cover sheet 33 by gripping and pulling and therefore peeling of tearing off tab 32. As shown in FIGS. 4 and 4*a* the removal of the cover sheet 32 provides also access to the following tab 35 for removal of the subsequent cover sheet 36.

Figure 5:
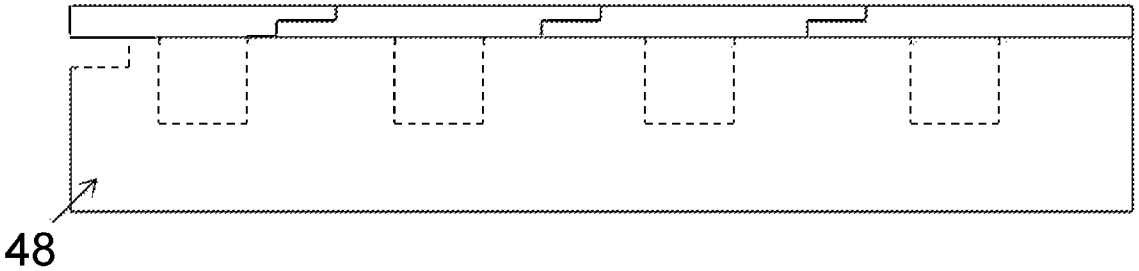
FIGS. 5 and 5*a* show a side view of a blister package according to one embodiment of the invention, where the carrier sheet comprises a rigid structure.
Figure 5A:
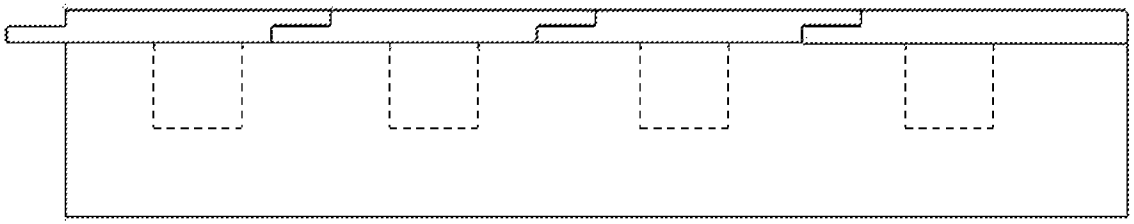

In another embodiment of the invention the carrier sheet of the blister package comprises a rigid structure as shown in FIG. 5, 5*a* and FIG. 6, 6*a*. A rigid structure may be a structure with the characteristic of being firm, having a certain degree of stiffness, unbendability and inflexibility so as to allow for safe handling in transportation, e.g. through normal post avoiding undesired rupture. Depressions may be produced by different technique, e.g. embossing, injection molding, calendaring, casting and other thermoplastic or pressure treatment and recesses between the depressions may be (FIG. 5) or not be present (FIG. 5*a*).

In some embodiments according to the second aspect of the invention the at least one depression adapted to accommodate pharmaceutical compositions on the top and at least one depression adapted to accommodate pharmaceutical compositions on the bottom surface of the carrier sheet are located off-set in respect to each other in an intermeshing fashion.

In some other embodiments according to the second aspect of the invention the carrier sheet comprises at least two pivotally connected halves each comprising one depression adapted to accommodate pharmaceutical compositions, and wherein the at least two halves are made from one single sheet foldable into a folded configuration thereby producing the rigid structure.

In some embodiments the at least one depression on one of the at least two halves of said carrier sheet is located off-set with respect to the at least one depression on the other of the at least two halves so that the depressions intermesh when the two halves are folded into the folded configuration.

In other embodiments the rigid structure is a solid block of material, e.g. the structure in between the depression is not hollow. For example in FIG. 5 carrier sheet 48 may be a block of material, i.e. a hard and solid piece of material.

Figure 6:
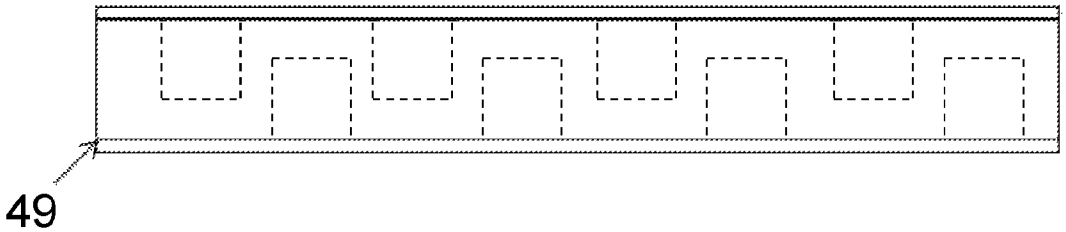
FIGS. 6 and 6*a* show a side view of a blister package according to one embodiment of the invention, where the carrier sheet comprises a rigid structure and the carrier has at least one depression on the top and at least one depression on the bottom surface of the carrier.

In some other embodiments the carrier sheet has at least one depression on the top and at least one depression on the bottom surface of its surface as shown in FIG. 6.

In some embodiments the rigid structure is or comprises an internal hollow structure. In some embodiments the rigid hollow structure may be internally filled with air or other gases, e.g. inert gases. For example in FIG. 6 carrier sheet 49 is a hollow rigid structure, i.e. no material is present between the depressions of the carrier. When the structure is hollow supporting means may be present to provide rigidity, e.g. supporting elements 50-57 in FIG. 6*a*.

In some embodiments, the at least two cover sheets are protected by at least one lid. Herein lid is defined as a removable film, foil, rigid sheet, panel or a hollow body which protects the cover sheet from undesired rupture.

In some other embodiments the lid may also contain a leaflet with information of interest to the patient, e.g. instructions on how to use the pharmaceutical compositions contained, or commercial for related medicaments.

In some other embodiments these information of interest for the patient may be printed, embossed, carved, stamped or etched on the internal or external surface of the at least one lid.

The at least one lid may be made of plastic, plastic laminates, plastic/paper laminates or plastic/metal foil laminates or metal. Non-limiting exemplary suitable plastics for the carrier sheet are laminates containing PVC, polyamides, polyolefins, polyesters, polycarbonates, teflon and combinations thereof. The at least one lid may be also made of material which is at least partially transparent in visible range of light as to allow for visual inspection pharmaceutical composition contained in the cavities of the carrier sheet.

In some embodiments the at least one lid is fully removable. In other embodiments the at least one lid may be opened through a rotation of the lid along at least one rotational joint located on the carrier sheet.

In some other embodiments the at least one lid is or comprise at least one adhesive element, such as a long thin piece of plastic, cloth or paper with binding capabilities, e.g. a piece of tape. In those embodiments access to the cover and carrier sheet can be obtained through a rotation of the lid along one of the edges of the carrier sheet.

Figure 6A:
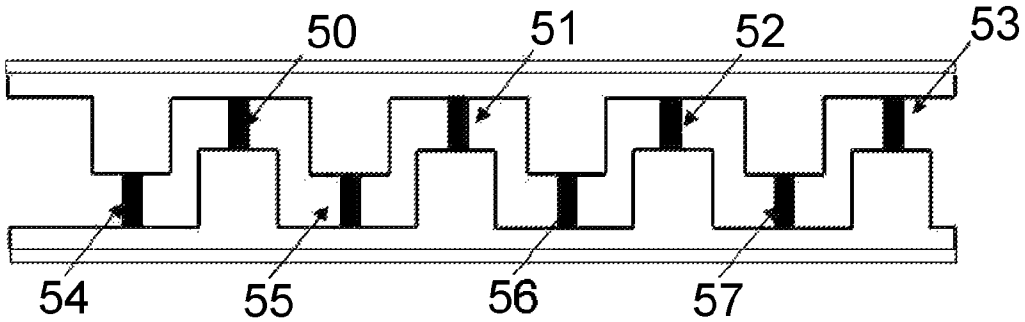

The several cover sheets leading to the access of the depressions according to the opening system of the invention for the packages shown in FIGS. 6 and 6*a* are not shown only for simplicity reasons in these figures.

In some embodiments the carrier sheet further comprises at least two rims areas each at least partly surrounding a carrier half, the rims protruding in a direction perpendicular to the cover sheet and adapted to engage with each other, when the blister package is closed.

In some other embodiments an outer foil is attached to areas adjacent the rims at a surface of the carrier sheet being the outer surface of the package when the package is closed.

Figure 14A:
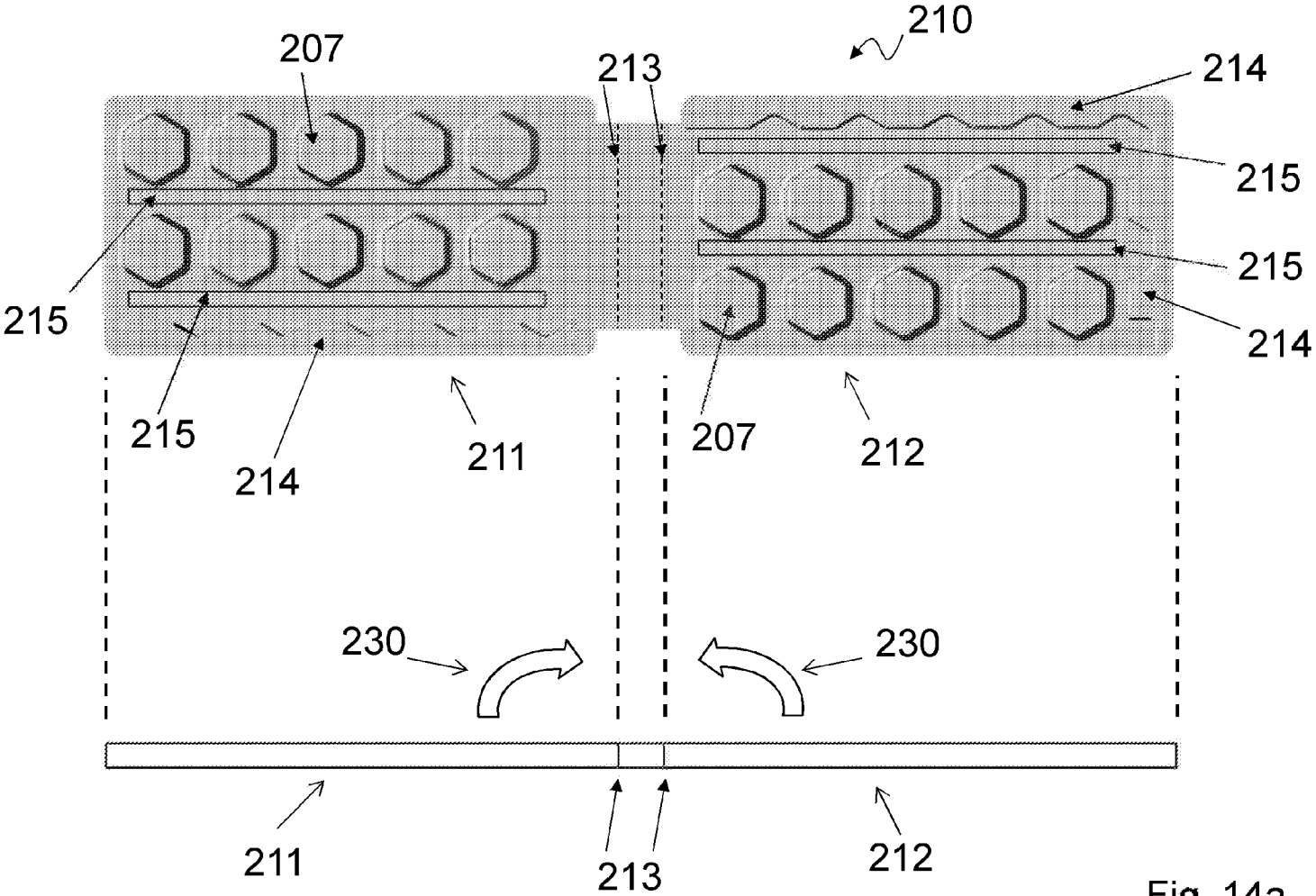
FIG. 14*a* shows schematically a top view of an embodiment of the invention where the carrier sheet is in an unfolded state.
Figure 14B:
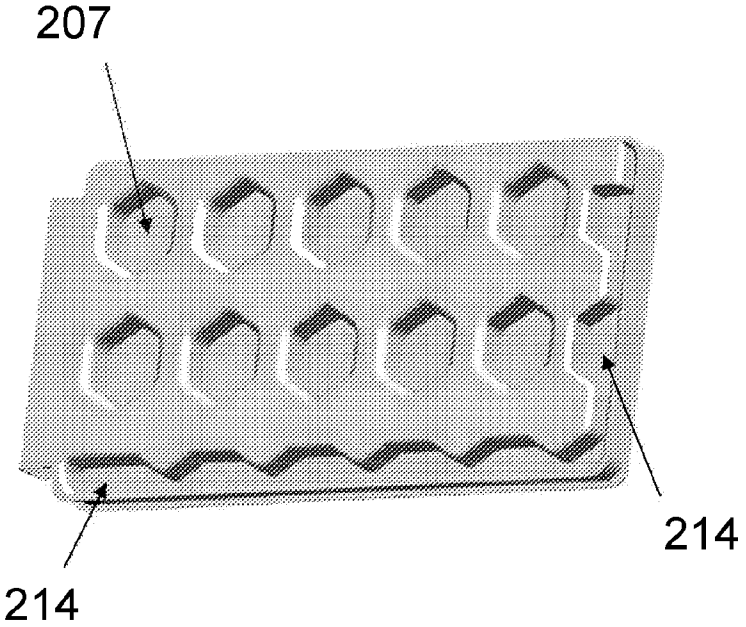
FIG. 14*b* shows schematically a 3-D view of the embodiment of the invention of FIG. 14*a* in its folded state.

In some embodiments the rigid structure can e.g. be obtained by a carrier 210 as shown in FIGS. 14*a* and 14*b*. The carrier 210 may be produced in a single foil in which two halves 211,212 each comprising cavities 207 arranged in rows may be identified. FIG. 14*a* and FIG. 14*b* show the carrier 210 in un-folded and folded state, respectively. The two halves 211,212 are adapted to be folded in such a way that the cavities 207 intermesh and thereby provide both stiffness and compactness to the carrier 210. The carrier 210 is preferably folded along two fold lines 213 so that the closed end of the cavities 207 lies on the opposite half, i.e. the closed end cavities 207 of half 211 lies on half 212 and vice versa, as shown in FIG. 14*a* following arrows 230. Such a design results in a carrier 210 where the pharmaceutical compositions are to be accessed from both sides of the carrier 210. The cavities 207 are covered by a cover sheet 208 as described above; preferably the same cover sheet covers both halves 211,212; it could also be that two separate cover sheets covers each half 211,212. The cover sheet 208 is preferably sealed to the carrier 210 before folding, but it can in principle also be attached after folding the carrier 210. In FIGS. 14*a* and 14*b*, the cavities 207 are honeycomb-shaped and arranged in two rows on each half 211,212 of the carrier 210. This configuration provides extra rigidity to a flexible blister structure once folded. In general in the folded state, the closed bottom part of the cavities 207 of the half 212 may support a correspondent area on half 211 and vice versa. Any other shape of intermeshing cavities which in the folded state can support the carrier sheet and provide rigidity to the final structure may be envisaged. Furthermore, rigidity and thereby protection of the pharmaceutical composition arranged in the cavities 207 is provided by the edge parts 214 being formed to provide barriers and support for the carrier sheet along the edges of the carrier 210 when folded. Other shapes and arrangements fulfilling the same purpose are also covered by the scope of the present invention. The fact that the two halves 211,212 are made from one folded sheet of material instead of using two separate sheets means that they are kept in a more fixed mutual relationship which adds to the rigidity of the carrier 210. To prevent the carrier 210 from unfolding, the two halves 211,212 of the carrier 210 can be joined e.g. by strings of adhesive 215, such as hot melt adhesive. Such joining will further prevent mutual movement of the two halves 211,212 and thereby also provide further rigidity to the carrier 210.

Figure 20:
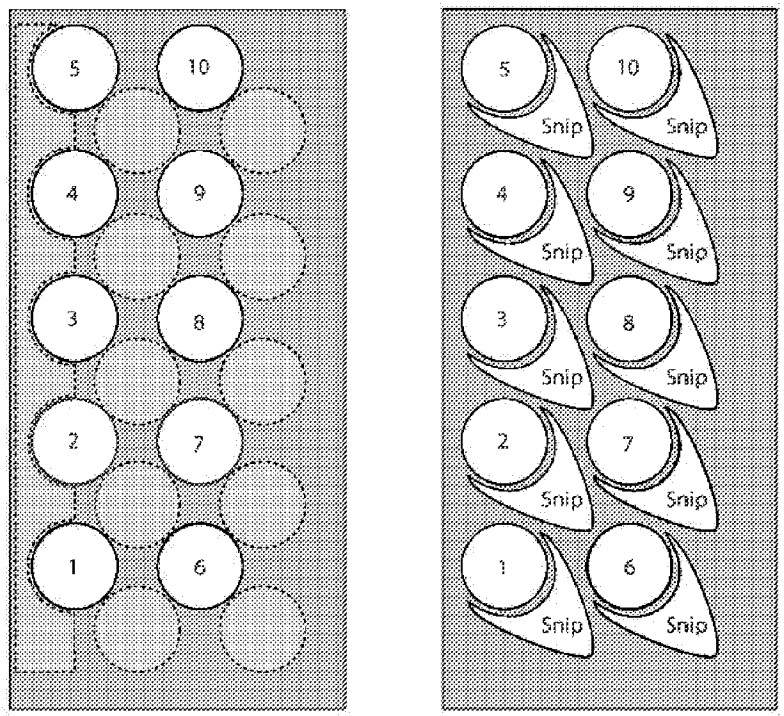
Figure 21:
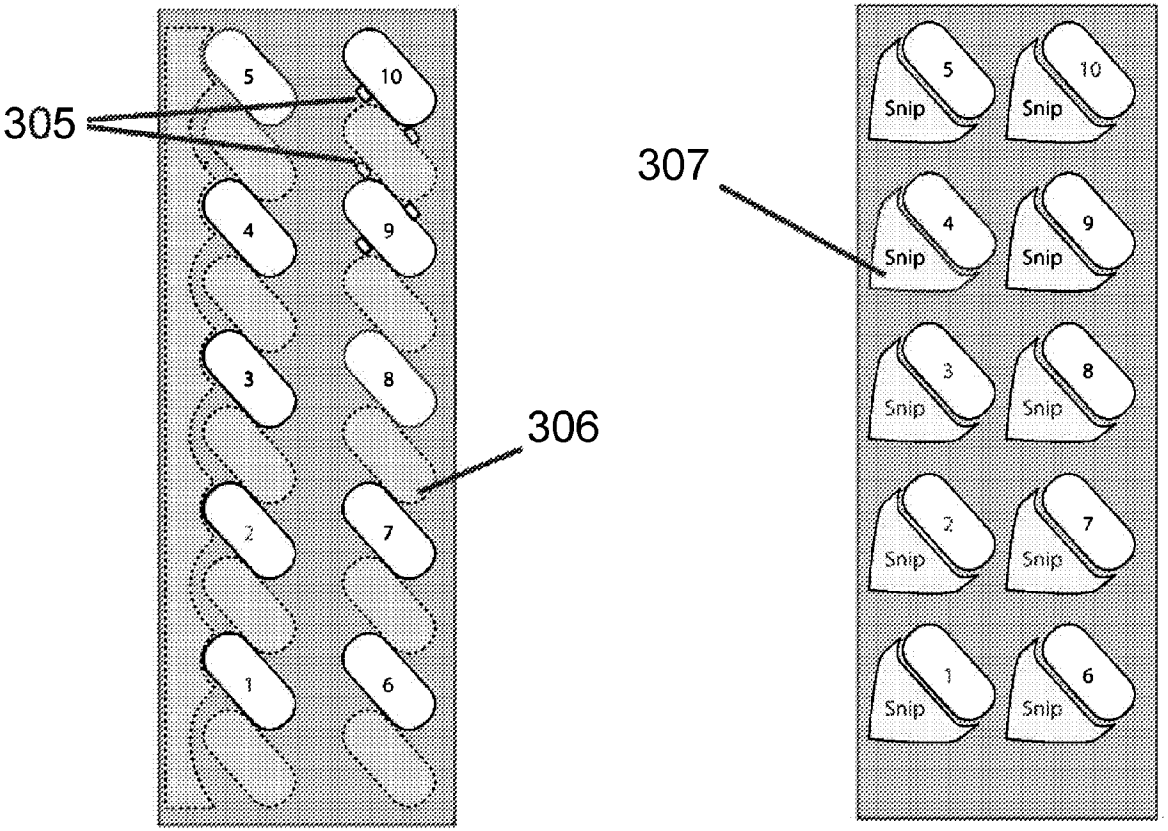

Furthermore cavities location on the surface of the carrier sheet can be optimized, e.g. by trial and error, so as to provide an optimal structure supporting the rigidity of the package and the sequential opening desired. For example FIGS. 19-23 show examples of packages where the location of the cavities on the surface of the carrier sheet may provide an optimal structure to increase the rigidity of the package and follow the desired sequential opening, e.g. following the numbered cavities. For example in FIG. 19, the different location of the cavities, e.g. 301 and 302, may also be coupled to a different location and design of the snip, e.g. 304 for removing the cover sheet and providing access to the cavity underneath. 303 identifies the glued area connecting top and bottom surface of the carrier sheet carrying blisters, e.g. 301 and 302. FIGS. 20 and 21 show two embodiments of the medical package with cavities and snips having an alternative shape. In FIG. 21 small bulges are 305 present between cavities, e.g. 306 and snip, e.g. 307.

Figure 22:
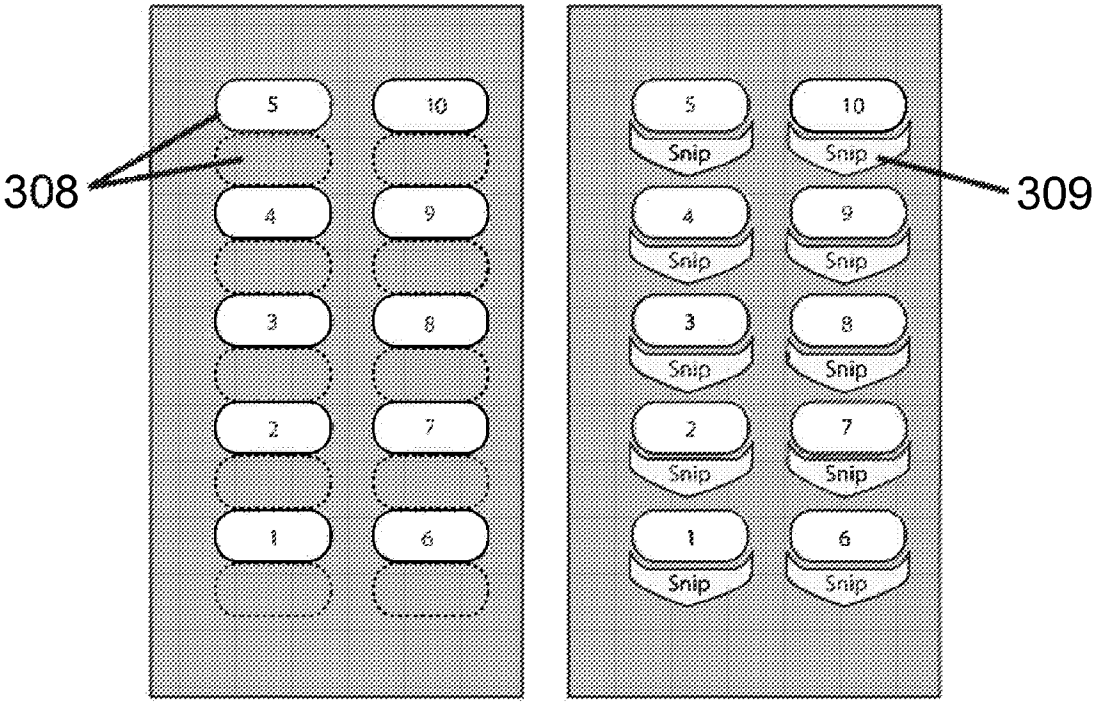
Figure 23:
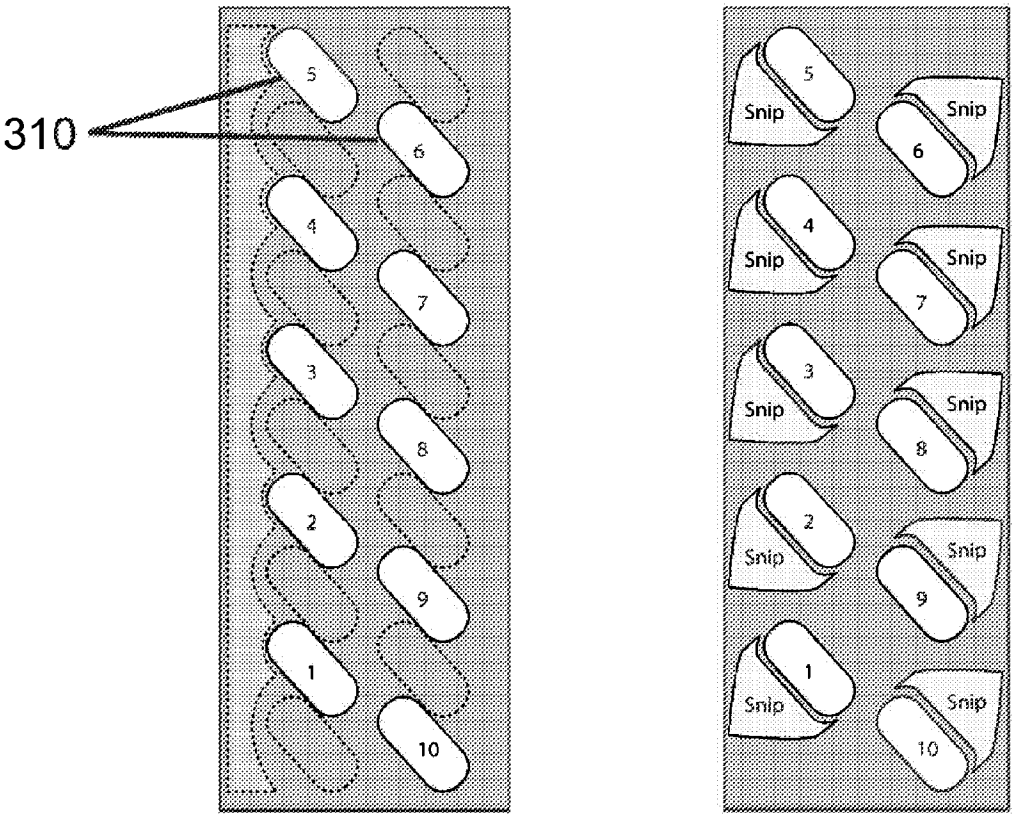

FIGS. 22 and 23 show further embodiments of the medical package with different combination of cavities, e.g. 308 or 310, and snips, e.g. 309. A desired sequential opening may be therefore obtained.

Figure 15A:
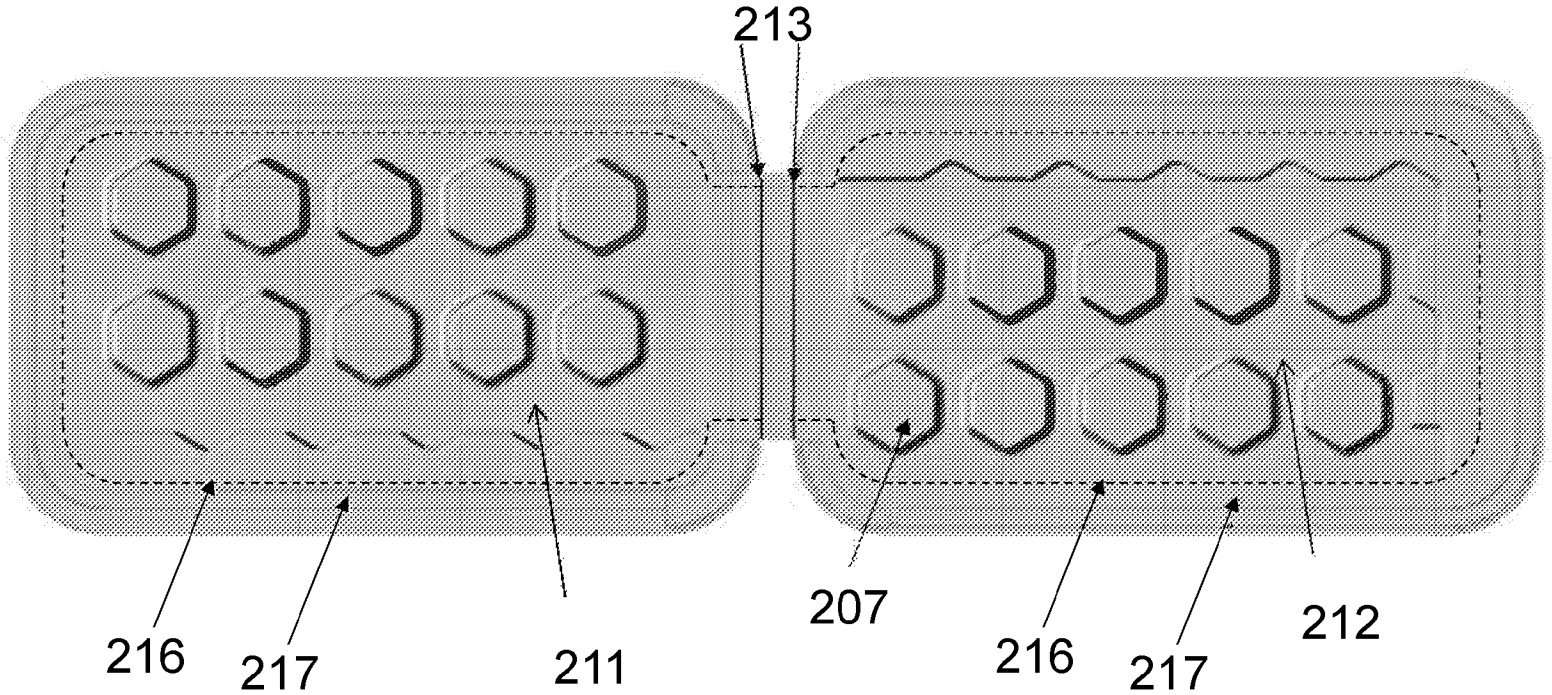
FIGS. 15*a,b,c,d* show an alternative embodiment based on the same principle of folding as in FIGS. 14*a* and 14*b*.
Figures 15B, 15D:
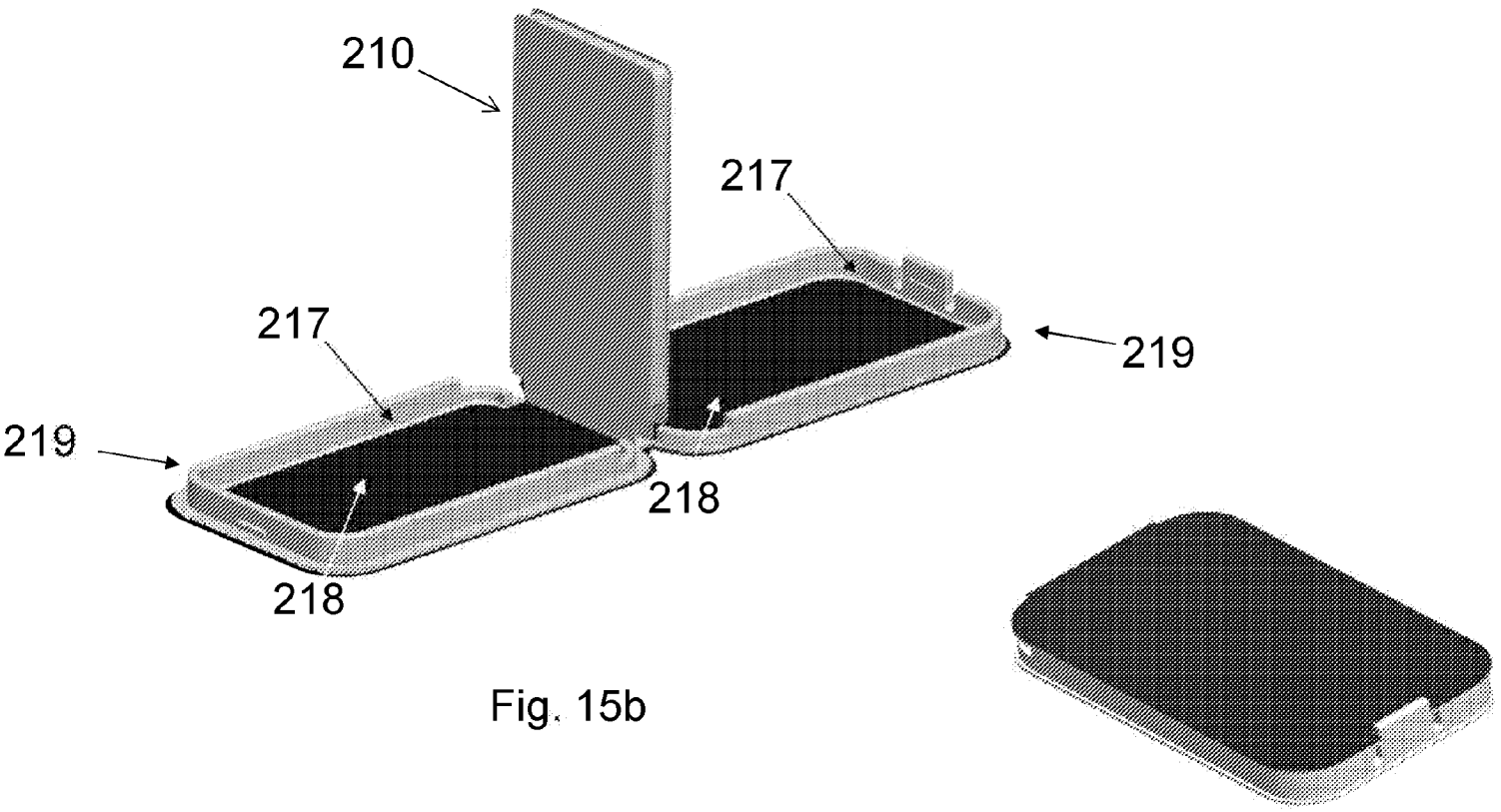
Figure 15C:
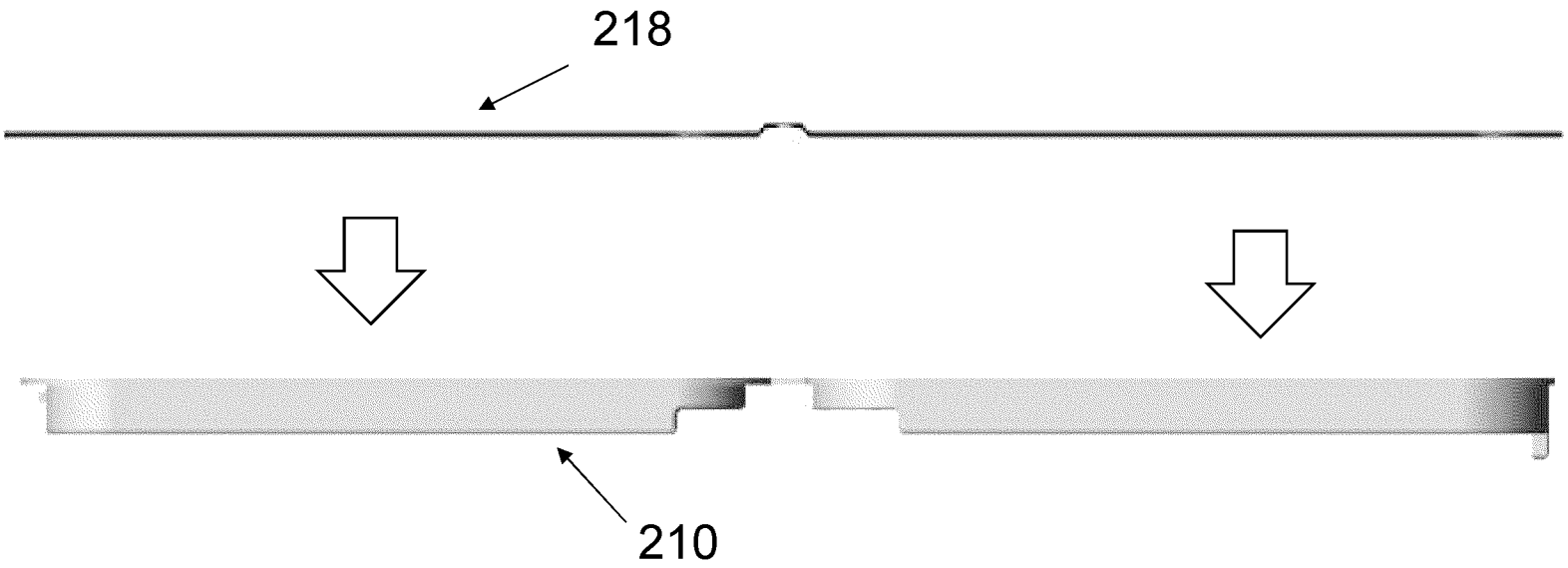
Figure 16A:
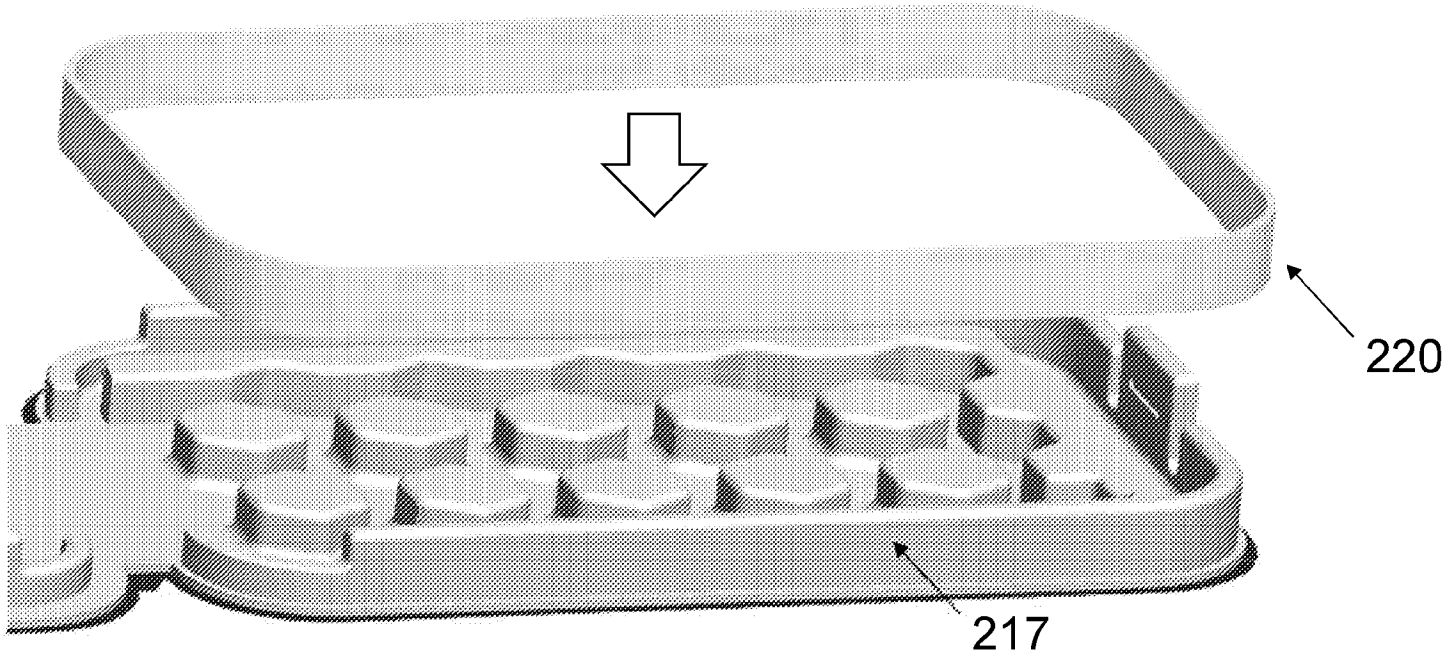
FIGS. 16*a* and 16*b* show schematically a 3-D view of the embodiment of the invention of FIG. 15*a,b,c,d* before and after fastening of a supporting ring respectively.
Figure 16B:
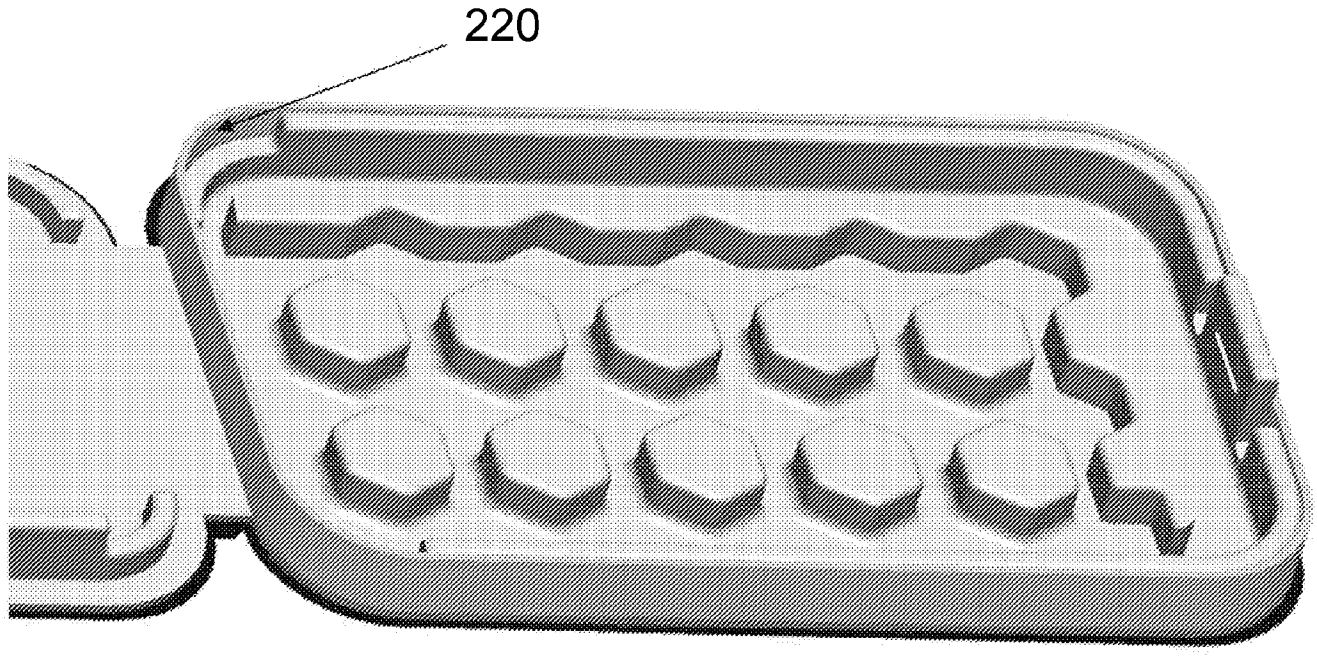

FIG. 15*a,b,c,d* show an alternative embodiment based on the same principle of folding as in FIGS. 14*a* and 14*b*. FIG. 15*a* shows the unfolded carrier 210, where the broken lines 216 show the shape of the carrier 210 in FIG. 14*a*. The embodiment in FIGS. 15*a,b,c,d* is provided with protruding rims 217 along the edges. The sheet to become the carrier 210 and the rims 217 is typically shaped by thermoforming a plastic sheet. After thermoforming to the shape in FIG. 15*a*, the sheet is punched along the broken lines 216 around the two halves 211,212 comprising the cavities 207. The two halves 211,212 are folded following arrows 230 as shown in FIG. 14*a* so as to reach the folded structure as shown in FIG. 15*b* which would leave the spaces between the rims 217 as holes. To obtain closed outer surfaces of the container, an outer foil material 218, such as a plastic foil, is fastened to the rim areas 217, preferably before the folding. The joining of the outer foil 218 and the rim area 217, and thereby to the carrier 210, is shown in FIG. 15*c*, and the resulting look is seen from FIGS. 15*b* and 15*d* in opened and closed state, respectively. In this way, the carrier 210 and thereby the pharmaceutical compositions will be protected by the sections 219 comprising the rims 217 and the outer foil 218 which will function as lids. If further rigidity and an even more closed design are desired, this can be obtained by adding a further ring 220 on top of each rim 217. This is shown in FIGS. 16*a* and 16*b* before and after fastening of the ring, respectively. The ring 220 can be fastened by any suitable means, such as by adhesive or by press fit.

In one embodiment the carrier 210 including the rims 217, following the punching along the broken lines 216, the filling with a pharmaceutical composition and the further covering by foil 218 is folded without separating rims 217 and carrier 210. Upon opening of the blister package the foil 218 sealed to the rims 217 will act as lids and the package opens along the broken lines 216 which have been punched following the thermoforming process. In this way further rigidity of the structure is obtained as the breakage along lines 216 is only achieved after the first use of the package, so as to avoid undesired opening during transportation from the producer to the first user of the package.

A first step in a presently preferred manufacturing method for the embodiment in FIGS. 15*a,b,c,d* would be to shape the sheet comprising the carriers 210 and the rims 217 to the geometry shown in FIG. 15*a*. This would typically be done by first thermoforming of a plastic sheet. The cavities 207 are then filled with the pharmaceutical compositions, and the cavities 207 are covered by a cover sheet 208, typically made from aluminium foil. The next step is punching where the carrier halves 211,212 are separated from the rim areas 217. In the same or in a subsequent punching step, flaps 201 can be made as previously described, e.g. in relation to FIG. 11*a,b*. Then the outer foil 218 is fastened to the rim areas 217 as shown in FIG. 15*c*. The outer foil 218 can be sealed and/or fastened e.g. by thermowelding or by gluing. The outer foil 218 can be a continuous foil providing further protection to the cover sheet 208, so that no access to the cover sheet 208 is possible unless outer foil 218 is removed following the opening of the package.

In some embodiments the outer foil 218 may either have the desired shape before fastening to the rim area 217, or it can be fastened as a sheet material covering a large number of containers so that it has to be punched to the desired shape after fastening.

All the steps described up to now can be performed without the need to turn the material which is advantageous from a manufacturing point of view. The following steps are preferably performed after rotating the containers by 180° so that what was before the underside becomes the top side. If desired, adhesive, such as strings of hot-melt adhesive is applied, and if desired, rings 220 of thermoformed plastic are arranged on top of the rims 217. The two halves 211,212 of the carrier 210 are then folded together and joined, and the "lids" comprising the rims 217 with the outer foil 218 are closed around the carrier 210. If desired, instructions for use of the pharmaceutical compositions can be arranged inside the container; it can e.g. be glued to the inner side of the outer foil 218 before the container is closed.

An alternative medical package having a build-in covering lid will be described in the following with reference to FIGS. 17*a,b,c* and 18*a,b*.

The blister package according to one aspect of the invention comprises at least four sections arranged in a row and made from a single sheet, each section being pivotally connected to at least one of the other sections along a fold line in the single sheet.

As single sheet is meant a continuos sheet of, e.g. plastic.

Each of two middle sections of said at least four sections may constitute a carrier half containing at least one depression adapted to accommodate pharmaceutical compositions, the two carrier halves being pivotally connected to each other.

Each of the two end sections of said at least four sections may constitute an outer cover part for at least one of said carrier half, each of the two end sections being pivotally connected the correspondent carrier half.

Correspondent is herein defined as the complementary carrier half according to FIGS. 17 *a,b,c* and 18*a* and 18*b*.

The least four sections are adapted to be folded into a folded configuration where the two carrier halves are located adjacent to each other with the depressions intermeshing and with the open sides of said depressions facing away from each other.

In this way each of the outer cover parts is located adjacent a carrier half.

Figures 17A, 17B:
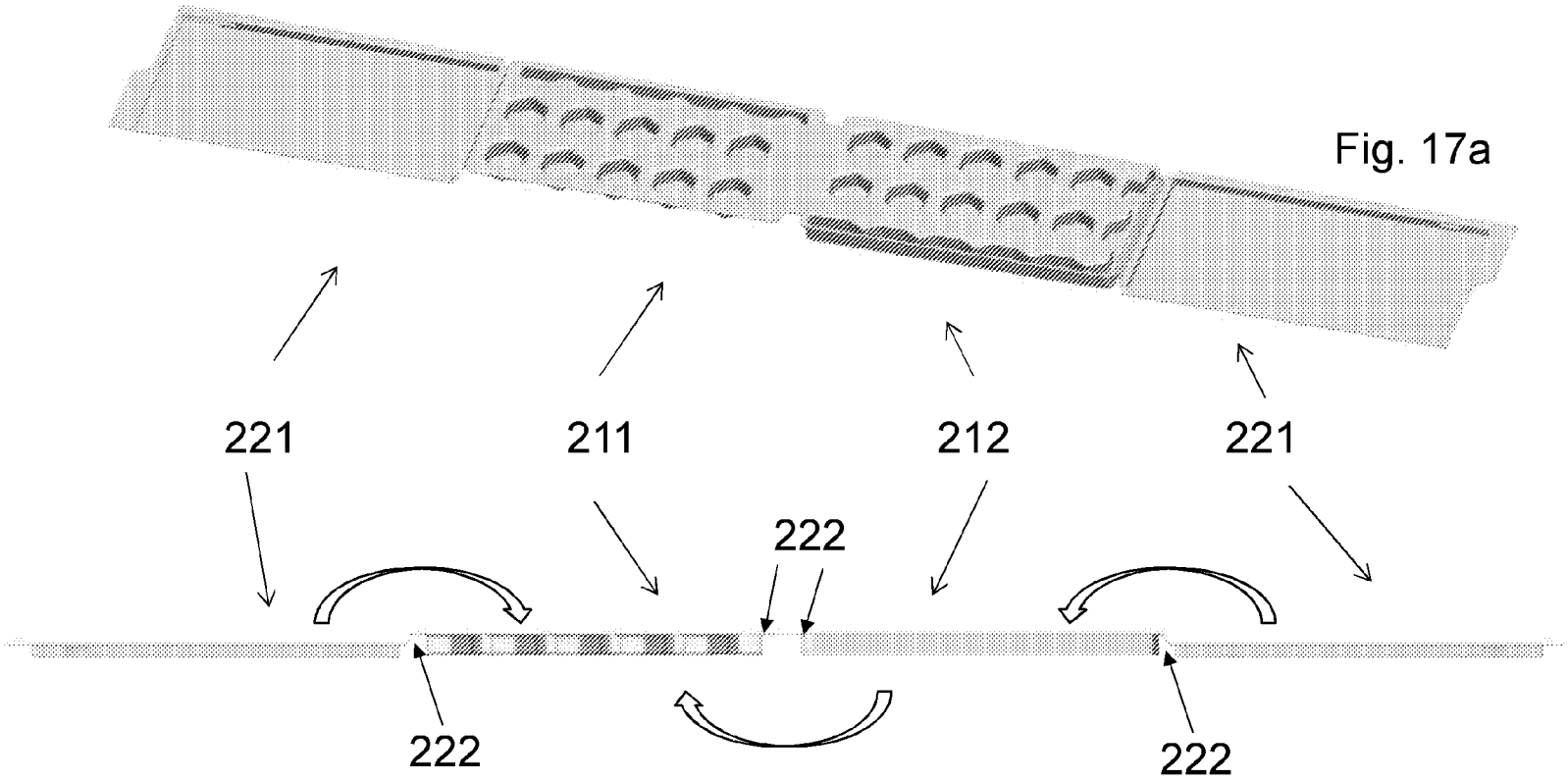
FIGS. 17*a, b, c
Figure 17C:
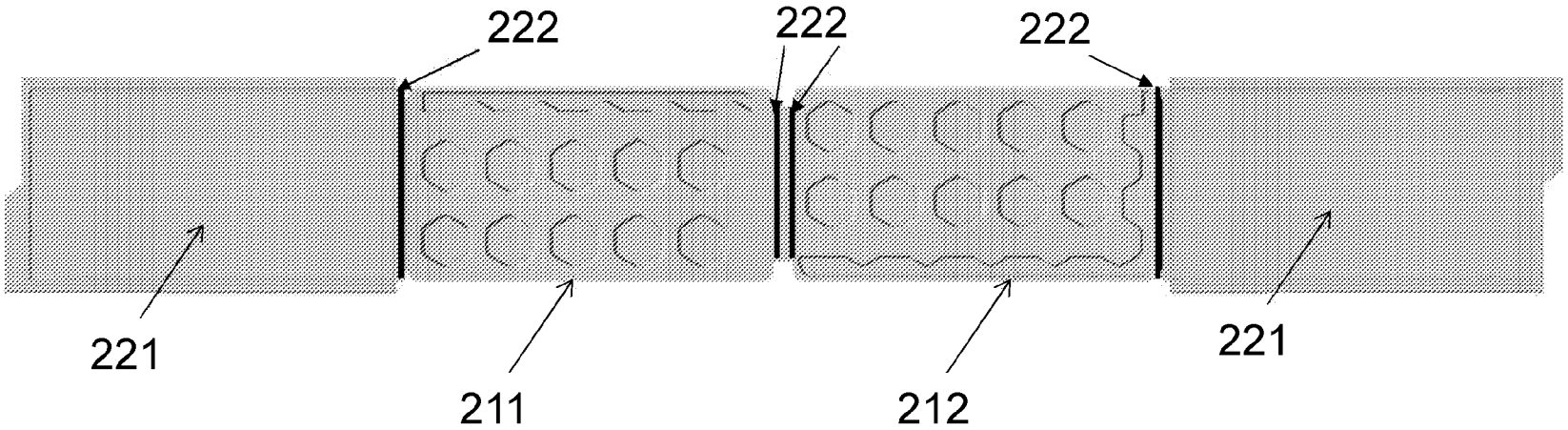
Figure 18B:
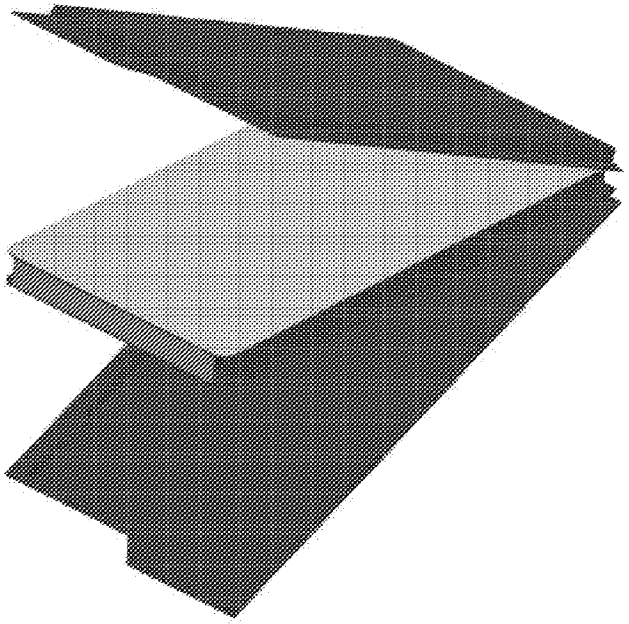
* and FIGS. 18*a* and 18*b* show schematically a top view and 3-D view of an embodiment of the invention having a build-in covering lid.
Figure 18A:
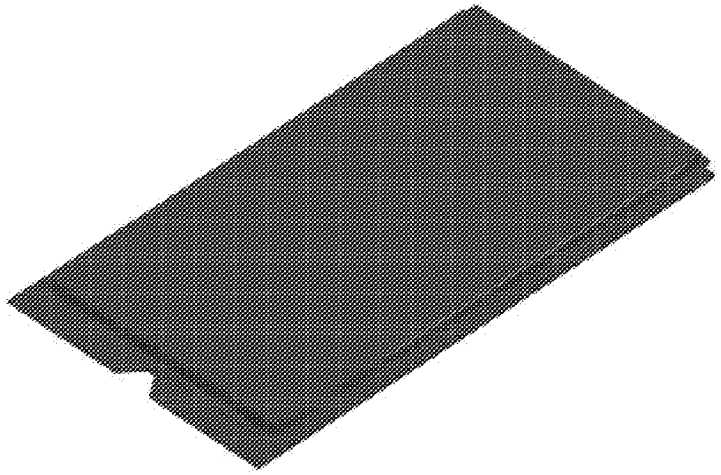
Figure 19:
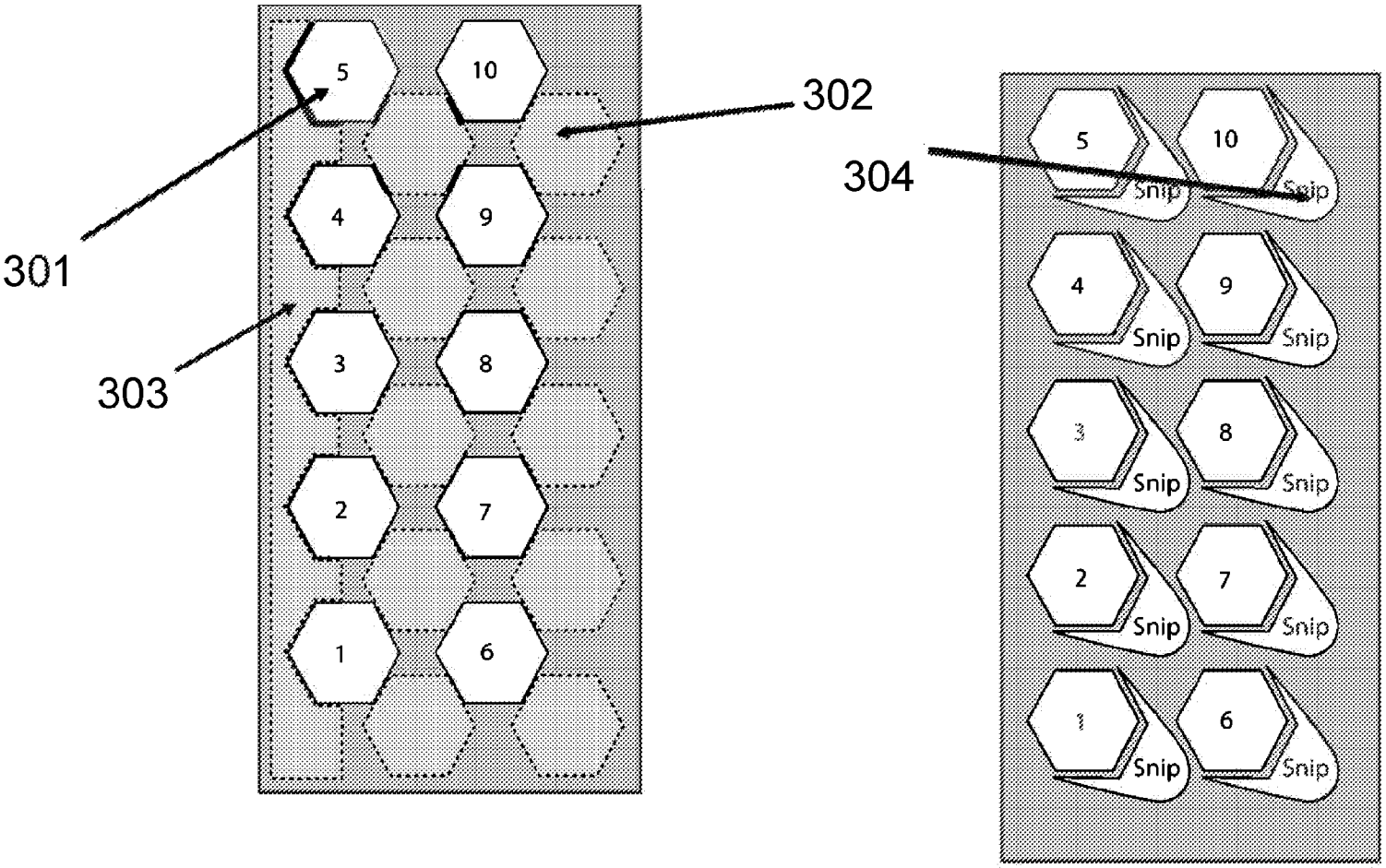
FIGS. 19-23 show examples of packages where the location of the cavities on the surface of the carrier sheet may provide an optimal structure to increase the rigidity of the package and support the sequential opening desired.

The design is based on the first step being thermoforming a plastic sheet to the shape shown in FIG. 17*a*. The sheet comprises a carrier sheet comprising two carrier halves 211, 212 corresponding to the ones in FIG. 14*a*. The sheet further comprises at the two distal ends of the carrier halves 211,212 two outer cover parts 221. These parts 221 are an extension of the carrier halves where the thermoforming has been performed so as to produce rims but not cavities for holding pharmaceutical compositions. It may be seen as an advantage that a single foil of plastic material may be thermoformed so as to identify parts having different functions, e.g. for carrying pharmaceutical composition or for providing further protection to the cover sheet protecting the cavities, without having to change its orientation. The plastic sheet is then folded into a container as shown schematically in the side view in FIG. 17*b* by folding along the fold lines 222 shown in FIG. 17*c*. In its folded state the blister package shows only the two cover part 221 as shown in FIG. 18*a*. When ready for use, it is possible to gain access to one side of the carrier 210 only by opening one of the outer cover parts 221 (not shown). FIG. 18*b* shows the container in a state where both outer cover parts 221 are partly opened. An advantage of this embodiment is that the carriers 210 and the outer cover parts 221 are made from the same sheet of material and no further covering is needed except for the cover sheets for covering the pharmaceutical compositions in the cavities 207.

In some embodiments a medical package with a larger capacity can be obtained by arranging more than two carrier halves in a row, which halves are then folded together and preferably joined by adhesive two-by-two. A double, triple or multiple structures can therefore be achieved where each two carrier halves may be joined two-by-two. In this configuration the two distal ends, i.e. the outer covers provide cover for the most external carrier halves.

In a multiple structure sequential opening may be achieved as in the single structured described. A further advantage may be that a package with increased numeber of cavities is made available for carrying pharmaceutical compositions.

Figure 7:
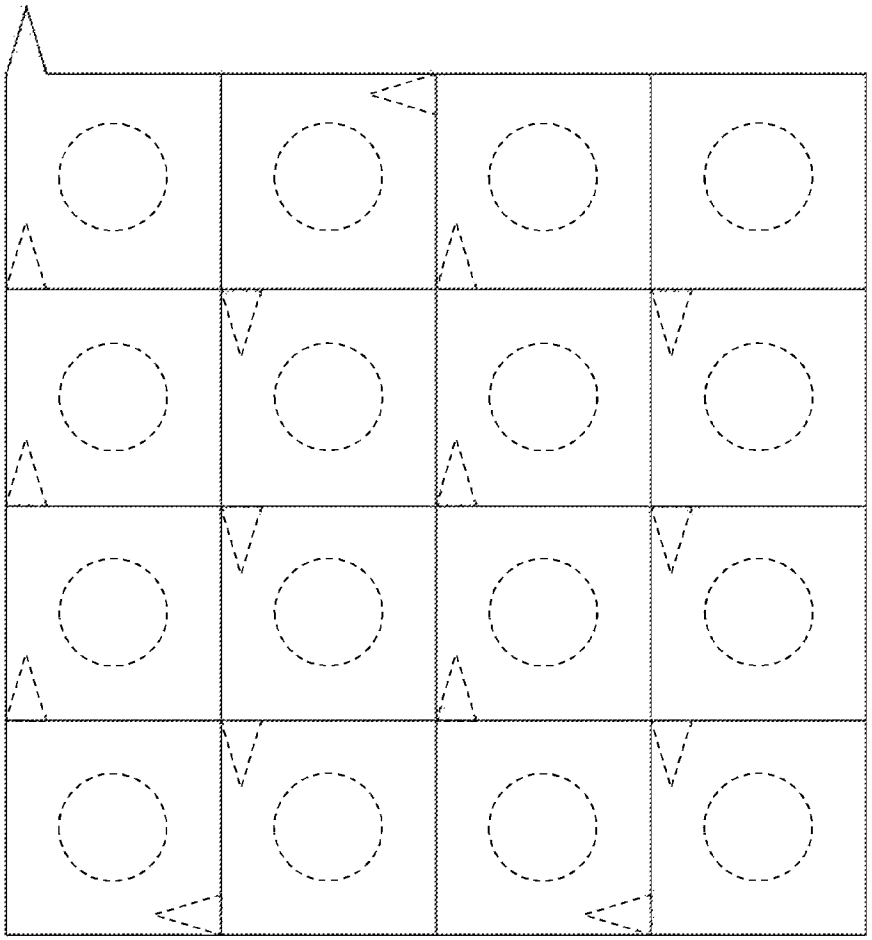
FIG. 7 shows a front view of a blister package according to another embodiment of the invention, comprising a grip flap.

In some embodiments the unsealed tab, which provides a better grip for peeling off or tearing off the cover sheet and gain access to the depressions, may be a flap, e.g. a strip or a snip. FIG. 7 shows a blister package according to another embodiment of the invention which comprises a flap.

The specific outline of the flap is linked to its function. The flap may have any form and size which allow for human or mechanical gripping by the method described by the invention and for tearing or peeling off. While in this embodiment the element is shown triangular in other embodiments it may assume different forms, e.g. circular or square.

Figure 8C:
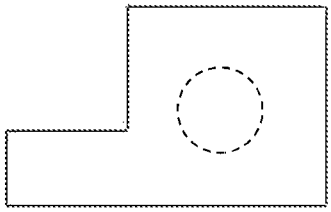
FIGS. 8*a*, 8*b* and 8*c* different shapes of the flap which can be used for a better grip of the cover sheet.
Figure 8B:
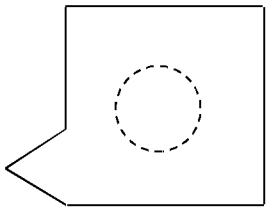
Figure 8A:
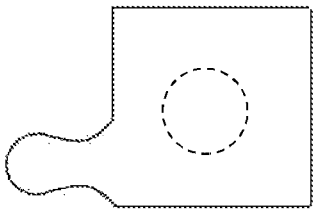

FIGS. 8*a*, 8*b* and 8*c* show different shapes of the grip flap which can be used for a better grip of the cover sheet.

In some embodiments the element, such a flap may be made of non-slippery material, such as rubber or may have a certain degree of roughness so as to provide a better grip and be easier to be gripped and torn or peeled off.

In some other embodiments it may have a user friendly shape, e.g. resembling a pad so as to provide a better user hold upon use.

The flaps in this embodiment are shown on a specific edge of the cover sheet. In other embodiments may be placed in different locations along the edges of the cover sheets.

By placing the flaps in different areas of the cover sheets, different sequence of opening are possible.

In some other embodiments the first flap can have a locking function so that upon removal of the first flap access the following flap and cover sheet is achieved without exposure of the first depression on the carrier sheet.

While the number and form of depressions in the packages is shown with a specific form, i.e. 16 cylindrical depressions, in other embodiments, the package may have less or more depressions and may have other forms, e.g. cubic, pyramidal or spherical.

Figure 11A:
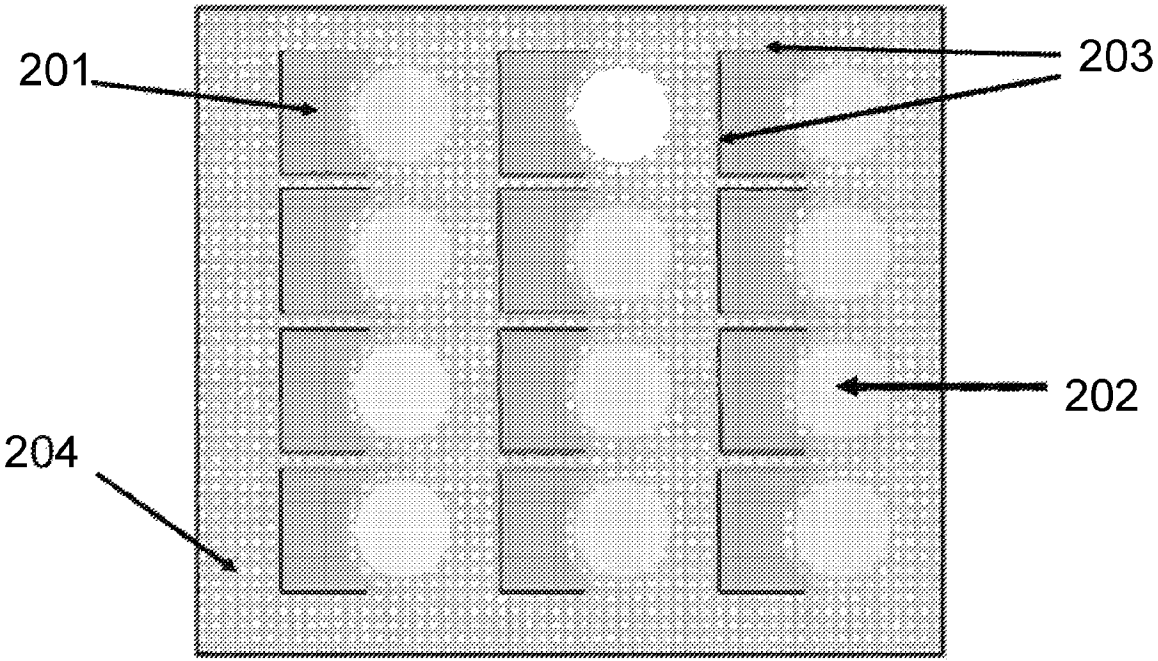
FIG. 11*a* shows schematically a top view of an embodiment of the invention.
Figure 11B:
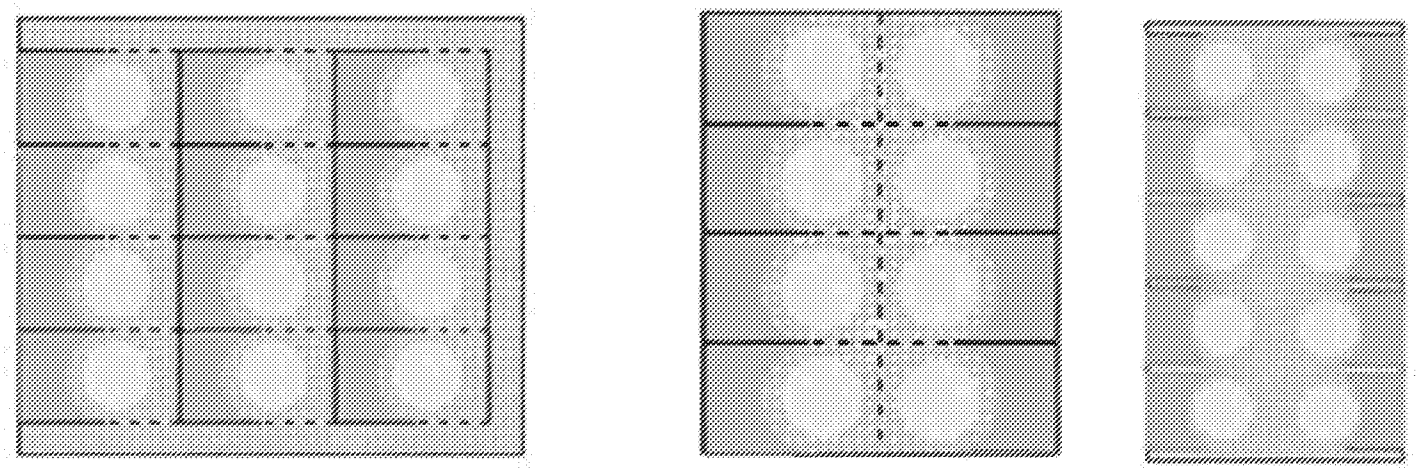
FIG. 11*b* shows different embodiments having different arrangements of the flaps and cavities.

FIG. 11*a* shows schematically a top view of an embodiment of the invention where a flap 201 is provided next to each cavity 202. The flaps 201 are obtained by leaving the areas underneath each flap 201 unsealed during manufacturing when the cover sheet is fastened to the carrier. In a, preferably subsequent, process step, the edges 203 of the flaps 201 are separated from the sealed part 204 of the cover sheet, typically by punching. The punching can be either through the cover sheet only or fully or partly through the carrier as well. An advantage of punching through the cover sheet only is that the carrier is left intact and thereby stiffer and less prone to failure. An advantage of allowing the punching to go fully or partly through the carrier is that the tolerances on the punching tools and the punching action can be less strict. FIG. 11*b* shows different embodiments having different arrangements of the flaps and cavities.

Figure 12B:
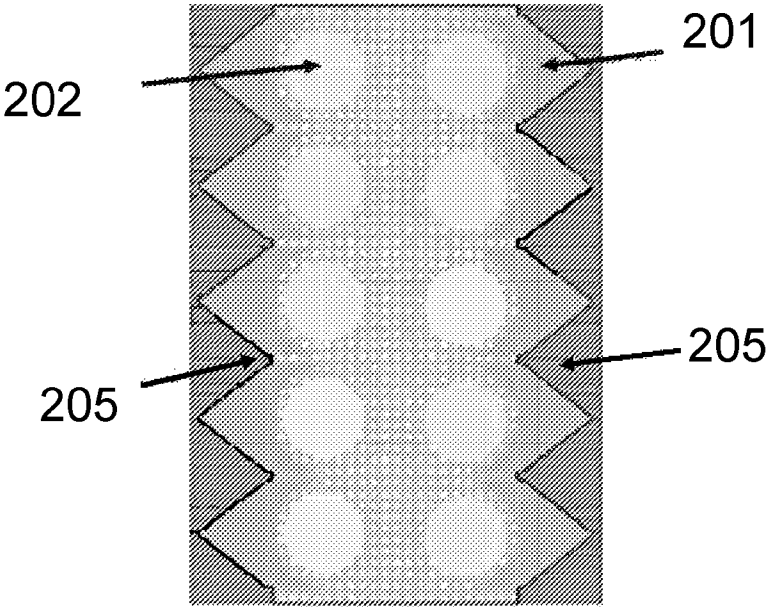
FIGS. 12*a* and 12*b* show schematically a top view of an embodiment of the invention where part of the cover sheet is removed during or after the punching process.
Figure 12A:
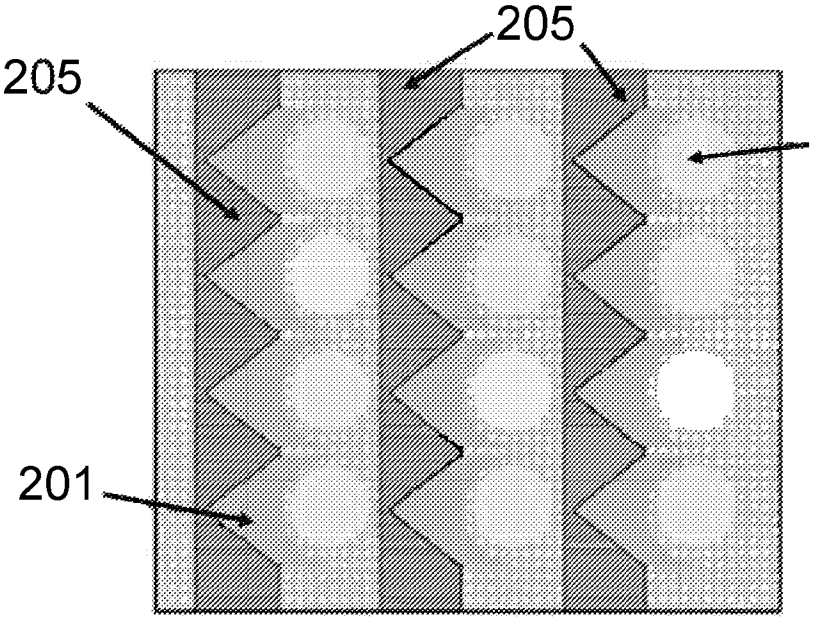

In an alternative embodiment to the one shown in FIGS. 11*a* and 11*b*, selected parts of the cover sheet are removed during or after the punching process. An example of such an embodiment is shown schematically in FIGS. 12*a* and 12*b*. The part of the cover sheet being removed is marked as 205 in the figures. This process may result in the flaps 201 being easier to grip. As shown in FIG. 12*b*, the cover sheet may project over the edges of the carrier e.g. by an amount corresponding to the size of the flaps 201 and the parts 205 of the cover sheet being removed. Hereby the flaps 201 may be even easier to grip than when they overlap the carrier.

Figures 13A, 13B:
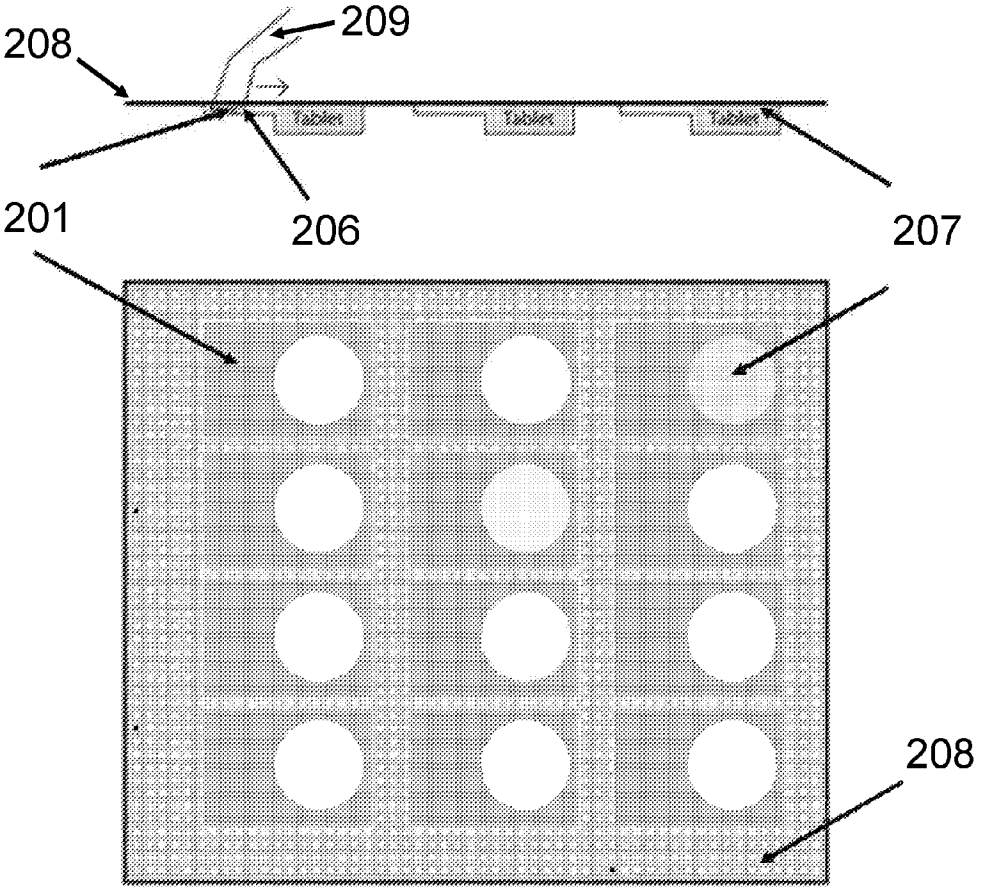
FIG. 13*a* shows schematically a top view of an embodiment of the invention where parts of the cover sheet are left unsealed.
FIG. 13*b* shows a cross section of the embodiment of the invention of FIG. 13*a*.

In still another embodiment shown schematically in FIGS. 13*a* and 13*b*, parts of the cover sheet are left unsealed to the carrier as in the embodiment in FIGS. 11*a* and 11*b*. The embodiments differ in that in the one shown in FIGS. 13*a* and 13*b*, the manufacturing does not include the providing of flaps 201 by punching. Instead there is a recess 206 next to each cavity 207, and to gain access to the content of a cavity, the cover sheet 208 is pressed into the recess 206 and the cover sheet 208 is removed from above the actual cavity 207. This action is typically performed by using a finger 209, but an appropriate tool could also be used. In this embodiment, the cover sheet 208 is preferably sealed to the carrier over the whole area not being a recess 206 or a cavity 207. An advantage of this embodiment is that no punching step is needed in the manufacturing process.

Figure 9:
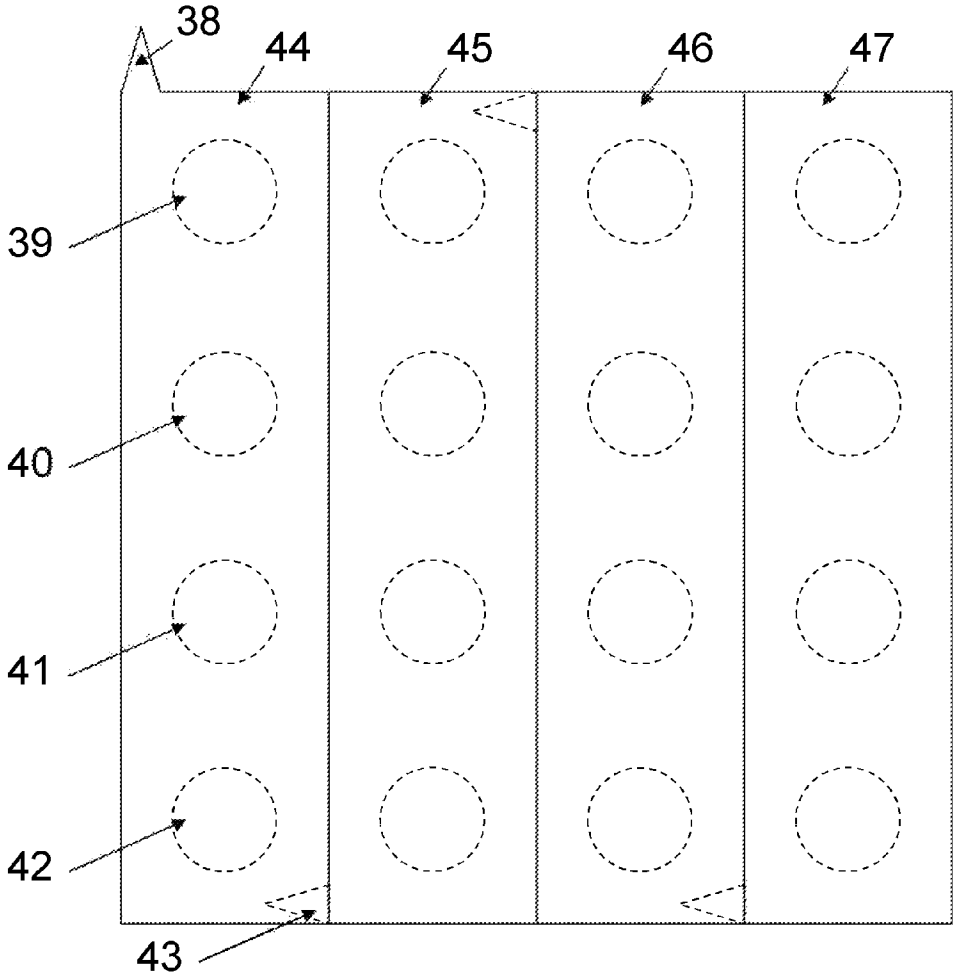
FIG. 9, 10 show blister packages according to other embodiments of the invention.

FIG. 9 shows a further embodiment of the invention where the blister package includes four cover sheets 44-47, each providing multiple access to 4 depressions. For example removal of cover sheet 44 by gripping pulling upwards and back flap 38 provides access simultaneously to depressions 39-42. In this way multiple dispensing of the pharmaceutical composition present in the depressions is achieved as by a single removal of the cover sheet, several depressions are accessible. Removal of cover sheet 44 provide also access to flap 43 which in turn allows for removal of cover sheet 45 providing access to the following 4 depressions.

Multiple dispensing may be very convenient for specific disease. For example, this can be particularly advantageous as a convenient, simple and effective way of facilitating the simultaneous administration of storage incompatible substance particularly when said substances are taken as part of a complex sequential daily therapeutic regimen.

Figure 10:
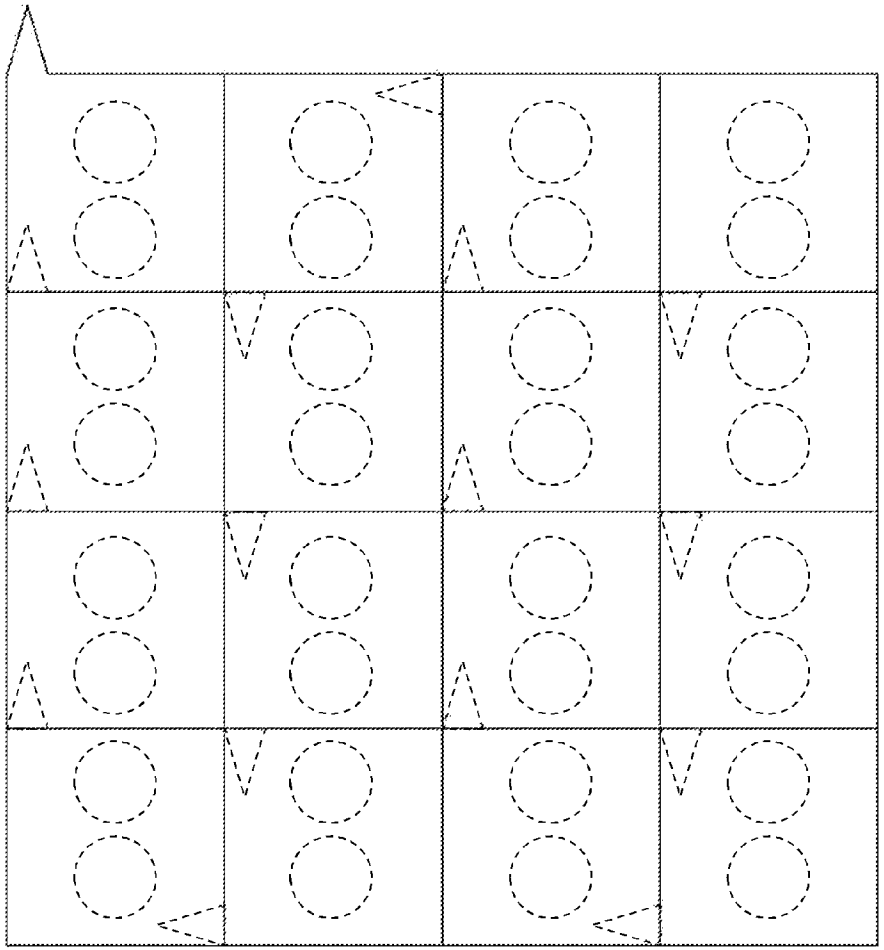

FIG. 10 shows another embodiment where removal of the first cover sheet provides simultaneous access to 2 depressions and to the flap for removing the following cover sheet. The advantage is also to facilitate simultaneous administration of prescription and non-prescription substances as part of a complex regimen.

Although the present invention has been described in connection with the specified embodiments, it should not be construed as being in any way limited to the presented examples. For example the carrier has been described as being made by thermoforming a plastic sheet. However, other manufacturing processes, such as thermoplastic moulding, are also covered by the scope of the present invention. The materials may also differ so that parts of the containers can be made e.g. polymer foam, composite materials or from paper-based materials, such as cardboard. Correspondingly, other joining methods than the ones mentioned are covered; such methods will be well known to a person skilled in the art. Any of the embodiments could be provided with closing and opening means as shown in the figures. Other possible designs of closing and opening means will lie within the person skilled in the art.

The invention claimed is:

1. A blister package comprising:

a carrier sheet with at least two separate depressions adapted to accommodate pharmaceutical compositions; and at least two cover sheets each covering at least one depression of the at least two separate depressions of the carrier sheet, wherein said at least two cover sheets are at least partially sealed to the carrier sheet around at least two depressions, and said at least two cover sheets overlap and delimit at least one element such that the access to said at least one element is gained by removal of the preceding overlapping cover sheet and the access to said further elements is gained by sequential removal of the respectively preceding overlapping cover sheets.

2. The blister package according to claim 1, wherein said element is a tear-off element.

3. The blister package according to claim 1, wherein said element is peel-off element.

4. The blister package according to claim 1, wherein said element is a snip.

5. The blister package according to claim 1, wherein said element is a strip.

6. The blister package according to claim 1, wherein said element is a flap which may have a protrusion so as to allow a better grip.

7. The blister package according to claim 1, wherein one of the at least two separate depressions of the carrier sheet is adapted to accommodate pharmaceutical compositions on the top and another one of the at least two separate depressions of the carrier sheet is adapted to accommodate pharmaceutical compositions on the bottom surface of said carrier sheet.

8. The blister package according to claim 7, wherein the at least one depression adapted to accommodate pharmaceutical compositions on the top and the at least one depression adapted to accommodate pharmaceutical compositions on the bottom surface of said carrier sheet are located off-set in respect to each other in an intermeshing fashion.

9. The blister package according to claim 1, wherein said carrier sheet comprises at least two pivotally connected halves each comprising one depression of the at least two separate depressions of the carrier sheet, wherein the at least one depression of said at least two separate depressions is adapted to accommodate pharmaceutical compositions, and wherein said at least two halves are made from one single sheet foldable into a folded configuration thereby producing said rigid structure.

10. The blister package according to claim 7, wherein the at least one depression on one of said at least two halves of said carrier sheet is located off-set with respect to the at least one depression on the other of said at least two halves so that the depressions intermesh when the two halves are folded into said folded configuration.

11. The blister package according to claim 1, comprising at least four sections arranged in a row and made from a single sheet, each section being pivotally connected to at least one of the other sections along a fold line in said single sheet.

12. The blister package according to claim 11, wherein two of the at least four sections are middle sections, each of two middle sections of said at least four sections constituting a carrier half containing at least one depression of the at least two separate depressions of the carrier sheet, the at least one depression adapted to accommodate pharmaceutical compositions, the two carrier halves being pivotally connected to each other.

13. The blister package according to claim 12, wherein two of the at least four sections are end sections each of the two end sections of said at least four sections constituting an outer cover part for at least one of said carrier half, each of the two end sections being pivotally connected the correspondent carrier half.

14. The blister package according to claim 9, wherein said at least four sections can be folded into a folded configuration where said two carrier halves are located adjacent to each other with said depressions intermeshing and with the open sides of said depressions facing away from each other.

15. The blister package according to claim 9, wherein said carrier sheet further comprises at least two rim areas each at least partly surrounding a carrier half, the rims protruding in a direction perpendicular to said cover sheet and being adapted to engage with each other, when said blister package is closed.

16. The blister package according to claims 1, wherein said at least two cover sheets are protected by at least one lid.

17. The blister package according to claim 1, wherein said carrier sheet has multiple depressions and removal of one of said at least two cover sheets provide simultaneous access to at least two depressions.

18. The blister package according to claim 17, wherein said carrier sheet has multiple depressions and removal of said cover sheets may be achieved through multiple starting points.

* * * * *